US009630748B2

(12) United States Patent
Keller

(10) Patent No.: US 9,630,748 B2
(45) Date of Patent: Apr. 25, 2017

(54) SYSTEM AND METHOD FOR A MULTI-USE GIFT PRESENTATION SYSTEM

(75) Inventor: Janet T. Keller, Eagan, MN (US)

(73) Assignee: MARCIANA Expressions, Eagan, MN (US)

( * ) Notice: Subject to any disclaimer, the term of this patent is extended or adjusted under 35 U.S.C. 154(b) by 358 days.

(21) Appl. No.: 13/213,716

(22) Filed: Aug. 19, 2011

(65) Prior Publication Data

US 2012/0051669 A1 Mar. 1, 2012

Related U.S. Application Data

(60) Provisional application No. 61/375,571, filed on Aug. 20, 2010.

(51) Int. Cl.

| | |
|---|---|
| ***B65D 30/20*** | (2006.01) |
| ***B65D 33/16*** | (2006.01) |
| ***B65D 81/36*** | (2006.01) |

(52) U.S. Cl.

CPC ..... *B65D 31/10* (2013.01); *B65D 33/16* (2013.01); *B65D 81/368* (2013.01); *B65D 2203/00* (2013.01)

(58) Field of Classification Search

USPC ..... 206/45.28, 232, 457, 459.5, 767–768; 383/4, 33, 78, 80, 93, 96; 229/103; 40/312–313

See application file for complete search history.

(56) References Cited

U.S. PATENT DOCUMENTS

| | | | | | |
|---|---|---|---|---|---|
| 1,612,166 | A | * | 12/1926 | Baldwin | 217/124 |
| 3,006,532 | A | * | 10/1961 | Fine | 383/6 |
| 4,379,519 | A | | 4/1983 | Sherwood | |
| 4,417,609 | A | * | 11/1983 | Sherwood | 383/33 |
| 4,657,176 | A | * | 4/1987 | Matsubara | 229/117.01 |
| 4,930,903 | A | | 6/1990 | Mahoney | |
| 5,226,532 | A | * | 7/1993 | Davidson et al. | 206/232 |
| 5,613,312 | A | * | 3/1997 | Crowell | 40/312 |
| 5,836,095 | A | * | 11/1998 | Crowell | 40/299.01 |
| 6,000,849 | A | | 12/1999 | Keller et al. | |
| 6,012,842 | A | * | 1/2000 | Openiano | 383/6 |
| 6,045,263 | A | | 4/2000 | Keller et al. | |

(Continued)

OTHER PUBLICATIONS

Paul, Johnson, Pop-up Paper Engineering: cross-curricular activities in design technology, English, and art, Falmer Press, 1992—115 pages.

(Continued)

*Primary Examiner* — J. Gregory Pickett
*Assistant Examiner* — Brijesh V. Patel

(57) ABSTRACT

A gift presentation system comprising: a gift bag comprising at least four side edge connected side walls, each side wall connected at its side edge to an adjacent side wall edge, each side wall connected at a bottom edge of each side wall to a bottom panel side edge of the gift bag, with a cavity formed by the interior surfaces of the side walls and bottom panel, and an opening formed by the connected top edge of each side wall of the gift bag a cover operably attached to the opening of the gift bag, the cover placed over at least a contained gift in the cavity of the gift bag and the cover operably secured to the gift bag; and an at least one decorative element operably attached to the cover that also operably assists to secure the cover to the gift bag.

2 Claims, 22 Drawing Sheets

(56) References Cited

U.S. PATENT DOCUMENTS

| | | | | |
|---|---|---|---|---|
| 6,146,018 | A | 11/2000 | Keller et al. | |
| 6,345,912 | B1 * | 2/2002 | Ho | 383/20 |
| 6,945,450 | B2 * | 9/2005 | Rusnock | 229/243 |
| 7,111,736 | B2 | 9/2006 | Petter | |
| D662,543 | S * | 6/2012 | Dennis et al. | D19/1 |
| 2003/0091245 | A1 * | 5/2003 | Mencacci | 383/6 |
| 2004/0094610 | A1 * | 5/2004 | Longo | 229/116.1 |
| 2007/0007167 | A1 | 1/2007 | Petter | |
| 2007/0039849 | A1 * | 2/2007 | Rodriguez | 206/457 |
| 2007/0138248 | A1 | 6/2007 | Wallen et al. | |
| 2009/0050505 | A1 * | 2/2009 | Rubin | 206/459.5 |
| 2011/0274374 | A1 * | 11/2011 | Rednour et al. | 383/4 |

OTHER PUBLICATIONS

Basic Packaging, Pepin Press (2010).
Paper Engineering for Pop-Up Books and Cards, Mark Hiner, Parkwest Publications (Apr. 1986).
Pop-Up!, a Manual of Paper Mechanisms, Duncan Birmingham, Tarquin Publication, (1997).

* cited by examiner

SYSTEM AND METHOD FOR A MULTI-USE GIFT PRESENTATION SYSTEM

RELATED APPLICATIONS

This invention claims priority to U.S. Provisional Application No. 61/375,571 filed on Aug. 20, 2010.

COPYRIGHT NOTICE

A portion of the disclosure of this patent document contains material which is subject to copyright protection. The copyright owner has no objection to the facsimile reproduction by anyone of the patent document or the patent disclosure as it appears in the U.S. Patent and Trademark Office patent file or records, but otherwise reserves all copyright rights whatsoever.

FIELD OF THE INVENTION

The present invention relates, in general, to the field of gift presentation and gift delivery using gift boxes and gift bags

BACKGROUND ART

Gift presentation has generally been limited to the gift box or gift bag markets. These gift presentation methods tend to be single-use systems having separate wrapping paper, bows, tape and other accessories that the gift giver needs to combine or hire to combine. These prior art methods create a great amount of paper and cardboard trash that goes into waste systems of communities, and offers the user a limited set of presentation options. These methods of gift presentation also require a certain level of experience to decorate adequately to maximize the beauty of the gift presentation. They also tend to be tedious to use in the case of wrapping paper system as it takes a signification amount of time to wrap each individual gift.

Gift bags, on the other hand are easier to utilize, but have gift capacity and concealment issues. Gift bags generally are not sealed. Unless the gift giver makes an effort to cover the gift with tissue or other filler, tape or otherwise seal the gift bag, the open top of the gift bag can reveal the gift within before the gift giver wants the recipient to see the gift. The gift bags also have another problem. To conceal the gift in the gift bag, the gift bag cannot be filled to the top by the gift. In other words, the whole space for the gift cannot be utilized to hold the gift, as the bag also must be big enough to seal or to place a covering like tissue paper to conceal the gift.

Addressing a gift has also traditionally required the giver to attach a tag, enclosure card or greeting card. Current gift wrapping systems do not have a method that ensures that the tag, enclosure, or greeting card will remain visible and fixed at a point where the gift giver wishes the tag, enclosure, or greeting card to be located. Other limitations of the prior art comprise failing to detect or warn someone who may be trying to tamper or view the gift at an earlier time than desired by the gift giver.

Additionally, gift presentation is more complicated when the gift container is a box. Gift boxes come in a large variety, but have three elements in common that make gift presentation difficult. 1) the boxes generally do not come decorated, 2) they are difficult to wrap well, and 3) the boxes generally do not allow the gift giver to mount or conceal additional secondary and tertiary gifts, like greeting cards, gift cards, prepaid gift cards, small gifts, cash, or other items to enhance the primary gift's novelty or the enjoyment of the gift recipient.

There is a need for a new decorative gift presentation system that enhances the attractiveness and eases of gift wrapping, heightens the gift giving surprise and suspense for the gift recipient (during unwrapping), stores folded, flat and compact during storage.

There is a need for a gift presentation system that is very convenient for shipping, protects gifts from damage, allows for the reuse of the gift presentation system elements and minimizes both landfill waste and recycling services.

There is also a need for the cover of the gift container to be able to cover, conceal and/or seal a gift container to securely hold the gift inside the container and also allow the maximum space inside the container to be utilized.

There is also a need when presenting a gift to provide a reliable means to mount and identify the gift recipient and gift giver. The gift container is configured in such a way where card is held conveniently at the top of the gift container.

There is also a need to enable the cover to be stored within the folded gift container if so desired.

There is also a need to be able to sell the gift presentation system in a mode that is point of sale compatible with most retail selling configurations.

There is also a need for the gift presentation system to be merchandised in a manner that comprises the providing option of having several varied covers, several varied gift mounting arrangements, and several varied attachable decorative or structural elements for a particular gift container so that the gift giver has a broad selection to obtain a unique gift presentation.

There is also a need to have a gift presentation system that allows all or most of the gift system to be reused and prevent landfill and waste.

There is also a need to create a presentation system that will enhance the gift giving experience by offering the gift recipient, a secondary use of the presentation system either as a functional item like a toy, game, or a luminary or to function as a decoration.

There is also a need to create a method of selling a uniquely customizable gift presentation system contemporaneous with the sale of a gift such that the gift presentation can be customized and delivered with the gift by a retailer.

SUMMARY OF THE INVENTION

To address the various needs of the market place, the present invention comprises a system for gift presentation comprising a gift container capable of containing a gift having at least four interconnected side walls and a bottom panel, including at least four side walls; a cover operably connected to the opening of the gift container; and a functional element operably connected the gift container. The functional element is defined as any element that may be added to the cover or the gift container that allows a decorative or structural component of the gift presentation system to enhance the gift giving experience of either the giver or recipient of the gift. The functional element may comprise a stiffener to maximize the available space in a lightweight and flexible container. The functional element also comprises a deployable gift, message or pop up decoration or other additional mounting support for a greeting card or a photo. The functional element also comprises a support for the cover or a decoration attaching to the cover or gift container. The present invention also comprises a set of reusable components, that allow, in many cases, opening the gift presentation system without damage, removing address tags and replacing them with new address tags, and reusing the remainder of the components at least a second time.

Another unique feature of the present invention is that in some embodiments, the gift container and its cover can be stored together in a flat folded position with the cover folded up inside the gift container. The cover is operably attached to the gift container and does not need a separate storage envelope. A great advantage of this present invention is that the cover is mounted and supported in a manner that the gift giver is allowed to use the full capacity of the interior cavity of the gift container as the cover deploys in a manner to keep the gift container, or a gift bag, side walls expanded to optimize space in the container or gift bag. The cover is deployed in a variety of manners such that a large number of various fastening means can be utilized to support the cover at the top edge of the gift bag upright side walls where cover securely holds and conceals gift within the gift bag while allowing a maximum amount of capacity for the gift bag.

To allow a gift giver the option to ship the gift presentation system without further wrapping, the cover or the gift box or bag maybe fabricated from paper, card stock, corrugated container materials, polymeric film or other suitable materials that facilitate shipping of the gift presentation system.

DETAILED DESCRIPTION OF INVENTION

Figure 1:
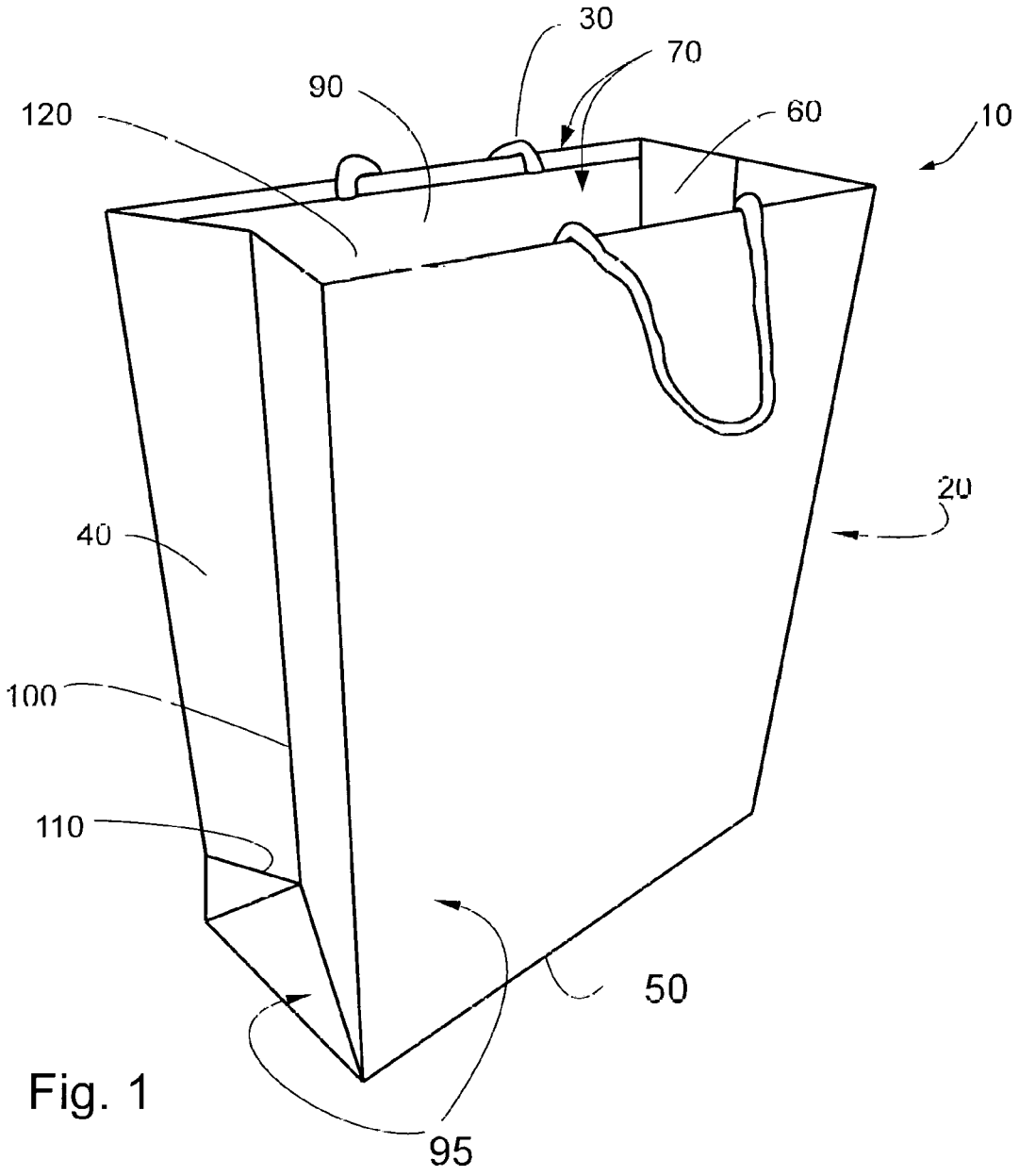
FIG. 1 Perspective view of a gift bag in an open condition showing the front and left sides and top thereof FIG. 2 Perspective view of a gift container box in open condition showing the front and right sides and top thereof.

The details of one or more embodiments of the invention are set forth in the accompanying drawings and the description below. Other features, objects, and advantages of the invention will become apparent from the description and drawings, and from the claims. Incorporated by reference to help teach the construction of basic gift bags and gift boxes is the book; *Basic Packaging*, Pepin Press (2010). Also incorporated by reference to teach basic paper engineering concepts for creating pop-up decorations and figures are the following publications: *Paper Engineering for Pop-Up Books and Cards*, Mark Hiner, Parkwest Publications (April 1986), *Popup Paper Engineering*, Paul Johnson, Falmer Press, (1992), and *Pop-Up!, a Manual of Paper Mechanisms*, Duncan Birmingham, Tarquin Publication, (1997), Referring now to the drawings in more detail and initially to FIG. 1, the number 10 generally designates a gift bag constructed in accordance with an embodiment of the present invention. The gift bag 10 comprises a bag body 20 and optionally, a pair of handles 30. The bag body 20 and handles 30 can have any construction known in the art. In the illustrated embodiment, the bag body 20 comprises a plurality of side walls 40 connected or integrally formed with a bottom panel 50. The side walls 40 cooperate to define an opening 60 adjacent an periphery 70 of the side walls 40 to permit access to an interior surface 90 of the bag body 20 that is defined by the side walls 40 and the bottom panel 50. Opposing side walls 40 may be provided with a vertical crease 100 to permit folding of the gift bag 10 in a manner known in the art. Similarly, a transverse crease 110 may be provided across at least two of the side walls 40 to permit folding of the bottom panel 50 upward for storage for the gift bag 10 in a flat or collapsed position. When opened, the gift bag 10 presents a cavity 120 for the placement of gift or other items.

This invention also contemplates use of gift containers 130 that comprise, separate covers or attached cover embodiments and can have any construction known in the art. Unless otherwise described, the present invention is generally intended to allow re-use of various components that are described in the specification to help prevent waste from a one-time use of the components.

This invention also contemplates use of gift boxes that comprise, separate covers or attached cover embodiments and can have any construction known in the art. Unless otherwise described, the present invention is generally intended to allow re-use of various components that are described in the specification to help prevent waste from a one-time use of the components.

Figure 2:
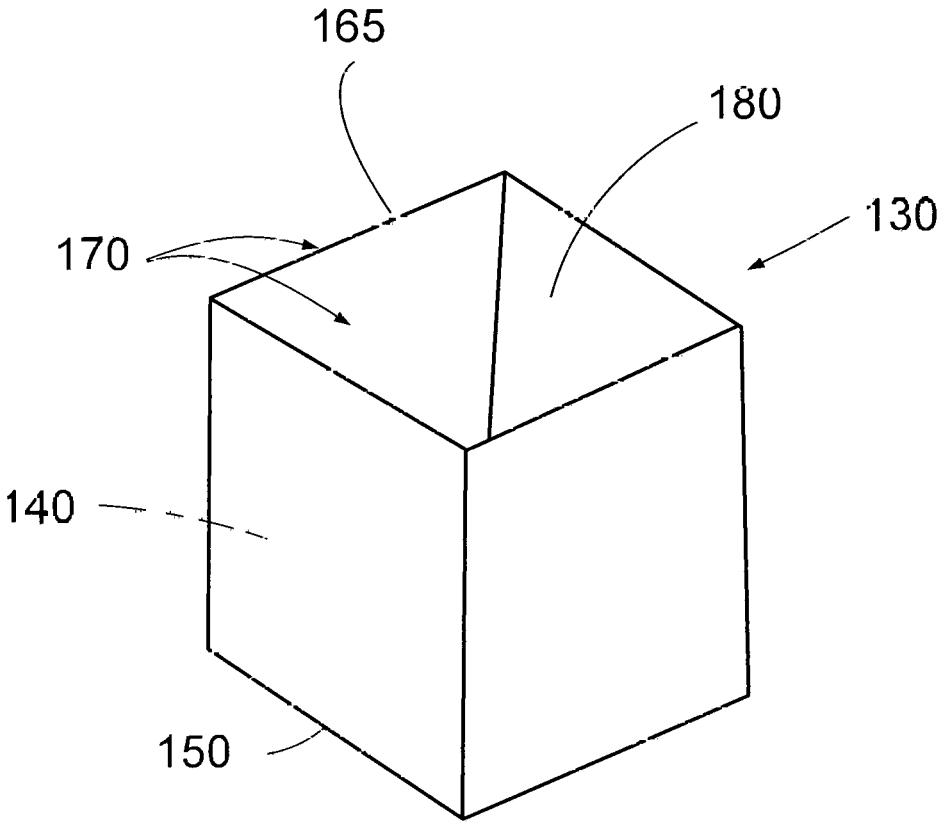
Figure 3A:
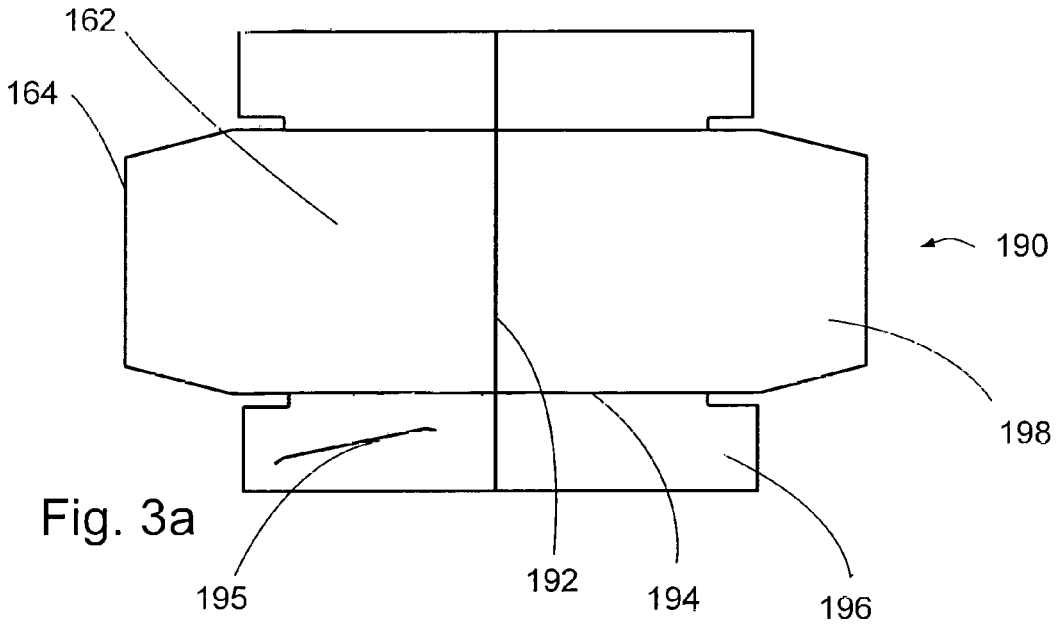
FIG. 3*a* Template view of an embodiment of a gift cover of the present invention showing the top, creases, and general shape thereof.

In FIG. 3*a*, the numeral 190 designates generally a cover constructed in accordance with an embodiment of the present invention. In general, the cover 190 of the present invention is generally shaped to fit and interface with the opening 60 or the periphery 70 of the gift container 130 or the periphery 70 or opening 60 of the gift bag 10 which were generally described in FIG. 2 and FIG. 1 correspondingly. In general, if the gift container 130 has a generally cover 190 shaped to the opening 165, the corresponding cover 190 would correspondingly have a generally square shape and generally would resemble the opening 165 in shape. The same concept would apply to the gift bag 10 and its opening 60 and its periphery 70. The cover 190 would be operably connected to either the gift bag 10 or gift container 130. The dimensions of the cover 190 can either be such that a cover 190 will fit within the opening 165 or periphery 70 of the gift container 130 or it will fit over the opening 165 of the gift container 130 or gift bag 10. Where the cover 190 fits into the opening 165 of the gift container 130, it may comprise an mechanical or interference fit where one or more edges of the cover 190 or a top surface 162 or a bottom surface 164 of the cover 190 will engage and interface with the opening 165 or periphery 70 of the gift container 130, side walls 140 comprising an interior surface 90 and exterior surface 95 with sufficient friction and force such that the cover 190 may be held in place. Correspondingly, the same would hold true when a gift bag 10 is used instead of a gift container 130. Another method of support would comprise making the length of the cover 190 longer than the opening 165 and inserting the extra length into the gift bag 10 to create an arch of the cover 190.

In FIG. 3*a*, the numeral 190 designates generally a cover constructed in accordance with an embodiment of the present invention. In general, the cover 190 of the present invention is generally shaped to fit and interface with the opening 60 or the periphery 70 of the gift container 130 or the periphery 70 or opening 60 of the gift bag 10 which were generally described in FIG. 2 and FIG. 1 correspondingly. In general, if the gift container 130 has a generally cover 190 shaped to the opening 165, the corresponding cover 190 would correspondingly have a generally square shape and generally would resemble the opening 165 in shape. The same concept would apply to the gift bag 10 and its opening 60 and its periphery 70. The cover 190 would be operably connected to either the gift bag 10 or gift container 130. The dimensions of the cover 190 can either be such that a cover 190 will fit within the opening 165 or periphery 70 of the gift container 130 or it will fit over the opening 165 of the gift container 130 or gift bag 10. Where the cover 190 fits into the opening 165 of the gift container 130, it may comprise an mechanical or interference fit where one or more edges of the cover 190 or a top surface 162 or a bottom surface 164 of the cover 190 will engage and interface with the opening 165 or periphery 70 of the gift container 130, side walls 140 comprising an interior surface 90 and exterior surface 95 with sufficient friction and force such that the cover 190 may be held in place. Correspondingly, the same would hold true when a gift bag 10 is used instead of a gift container 130. Another method of support would comprise making the length of the cover 190 longer than the opening 165 and inserting the extra length into the gift bag 10 to create an arch of the cover 190.

Figure 3B:
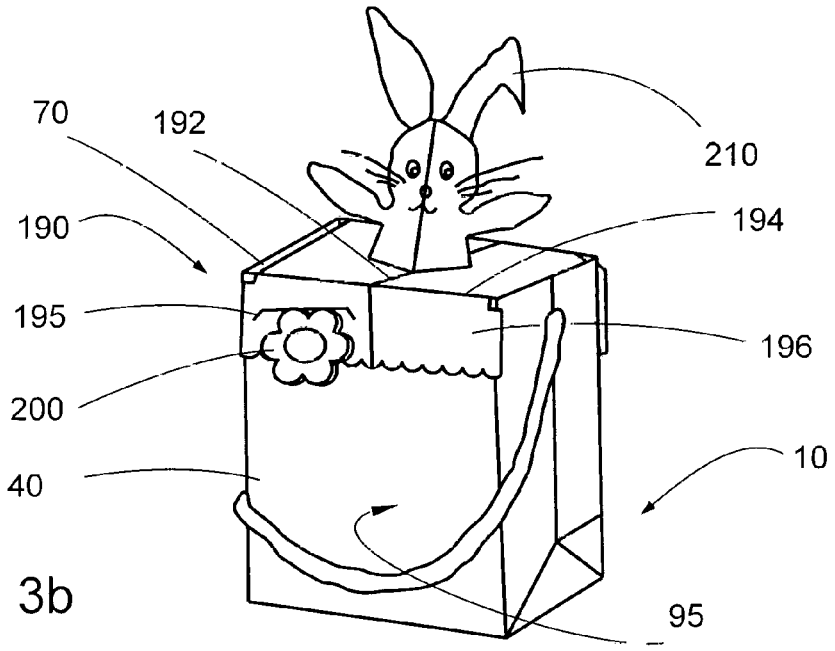
FIG. 3*b* Perspective view of an embodiment of a gift bag and gift cover of the present invention demonstrating how the template cover would be mounted in a general manner, showing front and right sides and top thereof.

Downward folded edge flaps 196 that contact the gift bag's exterior surface provide structural support to the gift bag 10 when the gift bag 10 is filled as the edge flaps 196 contact the gift bag exterior 96 and hold the periphery 70 and the opening to securely seal gift package even if the flexible gift bag is filled to a point where the bag side walls 40 distort, the cover 190 conceals gift in the gift bag 10. These edge flaps are made even more effective adding adhesive or mechanical fasteners to connect the edge flap 196 to the gift bag 10 surfaces where the edge flap 196 touches the gift bag 10. When downward edge flaps 196 on the cover 190 are designed to contact the interior surface 90 of a gift bag 10, the edge flaps 196 are designed to contact the gift bag 10 interior surface 90, side walls 40, the edge flaps 196 with structural creases 194 stiffen, open and extend side walls 40 to maximize the gift bag 10 capacity. Periphery is defined as a region or boundary (including edges and areas near edges, see 70) of any surface or area of a gift bag 10 or gift container 130. When edge flaps 196 are folded upwards beyond 30 degrees, the edge flap 196 creates a structural crease 194 that strengthens the cover 190. The edge flaps 196 and bag tabs 198 can comprise additional fastening means to securely seal the cover 190 to the gift bag interior 90 where the gift bag upper portion and edges are in contact. The present invention comprises the placement of adhesive or mechanical fastening means on the edge flaps 196 and bag tabs 198 to securely seal to the periphery 70 of the gift bag 10. Therefore even if the gift bag 10 is filled with gifts where the side walls 40 distort, the cover 190 still conceals the gift. The mounting slot 195 allows the addition of a gift tag 200 or an additional decoration or other item in the cover 190. Once articulated into a cover 190 as shown in FIG. 3*b*, the cover 190 is placed over the top of the gift bag 10 in conjunction with the gift tag 200. Other mounting options for mounting slot 195 include mounting a greeting or gift (i.e. pre-paid gift card.) The cover 190 also comprises the addition of a decoration 210 that may be fixed or detachable. As may be readily seen, this configuration allows for the support of the weight of additional decorations as well as general enhancement of the gift presentation.

As stated above, there are many embodiments to the present invention. These embodiments may be used in combination or individually to create novel and attractive presentations of gifts or other items. To help the reader understand the invention better, the invention is presented in series of embodiments that describe improvements affecting individual elements of the invention. This organization in no way is intended to limit the invention to individual improvements as the invention is styled to allow combinations of many improvements in addition to singular improvements.

Exemplar Description of Improvements to Gift Presentation Covers

Figure 4A:
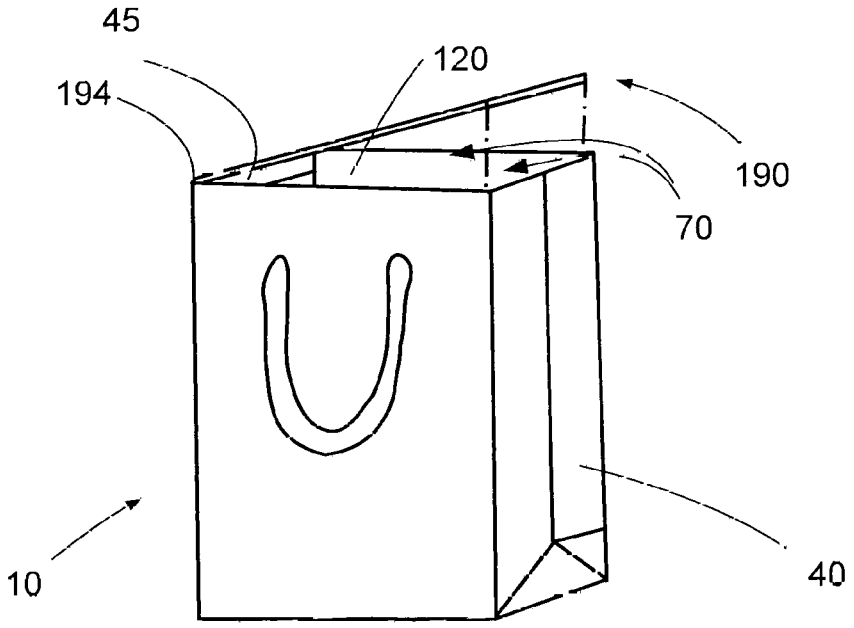
FIG. 4*a* Perspective view of an embodiment of a gift bag and gift cover of the present invention demonstrating a deployable cover showing the front and right sides and top thereof FIG. 4*b* Partial perspective view of an embodiment of a gift bag and stored gift cover prior to deployment, showing the front and right sides and top thereof.
Figure 4B:
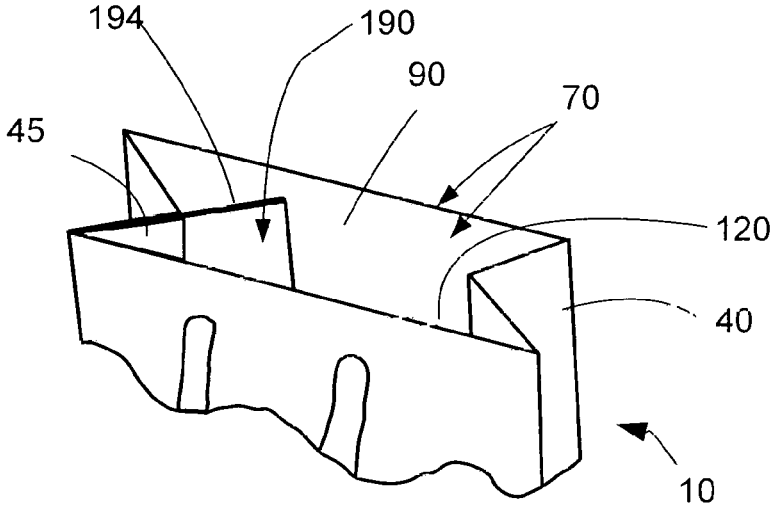

The present invention comprises 1) separate covers 190 that operably attach and may be stored flat and folded a) in the envelope of the gift bag 10 or gift container 130 or b) lay flat on gift bag 10 or gift container 130 exterior 2) covers 190 that are operably attached to gift bag 10 or gift container 130 which fold to store a) within cavity 120 or b) fold flat along the exterior of gift bag 10 or gift container 130. In FIGS. 4*a* and 4*b*, an embodiment of an improved cover 190 of a gift bag 10 comprising improvements that enhance its gift presentation or to help improve the structure of cover 190, to improve the concealment of the gift and to help seal the gift bag 10. In this exemplar, the cover 190 is stored within the gift bag 10 and is operably attached 45 (by adhesive or by other means) to part of the side wall 40 of the gift bag 10. The cover 190 is deployed by lifting the cover 190 up, rotating the structural crease 194 and inserting a gift into the bag cavity 120 and then placing the cover 190 inside the interiors surface 90 of periphery 70. The cover 190 either is locked in place by the gift bag 10 and the cover 190 in mechanical interference or the cover 190 may be attached by adhesive as may be applied to either cover 190 or gift bag 10 to seal the gift. Location of the adhesive would comprise location on the gift bag 10 interior surface 90 in the periphery 70 or on the cover 190 with edge flaps 196 or bag tabs 198, if present, (as described in FIG. 3*a*) sufficient to seal the gift bag 10. The height of the gift bag 10 allows the cover 190 to lay flat inside the gift bag 10 as a portion of the cover 190 is operably attached to the gift bag 10 via an adhesive area 45, and then the remaining portion of the cover 190 is left non-folded in the cavity 120 of the gift bag 10. More specifically, in FIG. 4*b*, the gift bag 10 is shown with a cover 190 ready to deploy. The cover 190 is attached to the gift bag 10 in adhesive area 45 and the structural crease 194 is shown prior to the cover 190 being lifted out of the gift bag 10.

For the purposes of uniformity and teaching the invention, a gift bag 10 is shown in the following FIGS. 4-12, and 14-15. This is for illustrative purposes only and not intended to narrow the present invention in any manner. Enhancing the presentation value of the gift is one of the paramount functional improvements. Covers 190 in this invention can carry decorations, greeting cards, deploy messages, hide secondary gifts, maximize the space necessary for the gift inside and allow the designer to make the covers useful beyond the its normal functional use of sealing a gift container. For the purpose of this invention secondary gifts are defined as comprising any secondary item given with a primary gift. Examples of secondary gifts comprise greeting cards, gift cards, candy, pre-paid gift cards, credit or debit cards, data storage devices, camera flash card, CD disks, DVD disks, flash drives, photos, and other items typically given with a primary gift to enhance the pleasure or enjoyment of the gift giving experience.

Exemplar Descriptions of Structural Improvements to a Gift Bag Cover

Figure 5A:
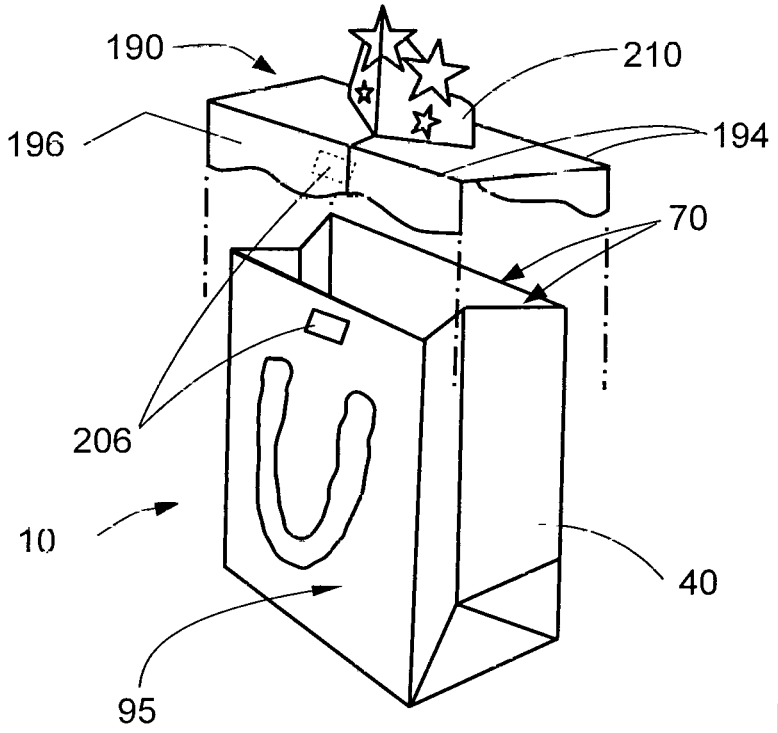
FIG. 5*a* Perspective view of an embodiment of a gift bag, a gift cover and a mounted decoration of the present invention showing an exploded view of the gift cover interfacing with external surfaces of the gift bag showing the front and right sides and top thereof.
Figure 5B:
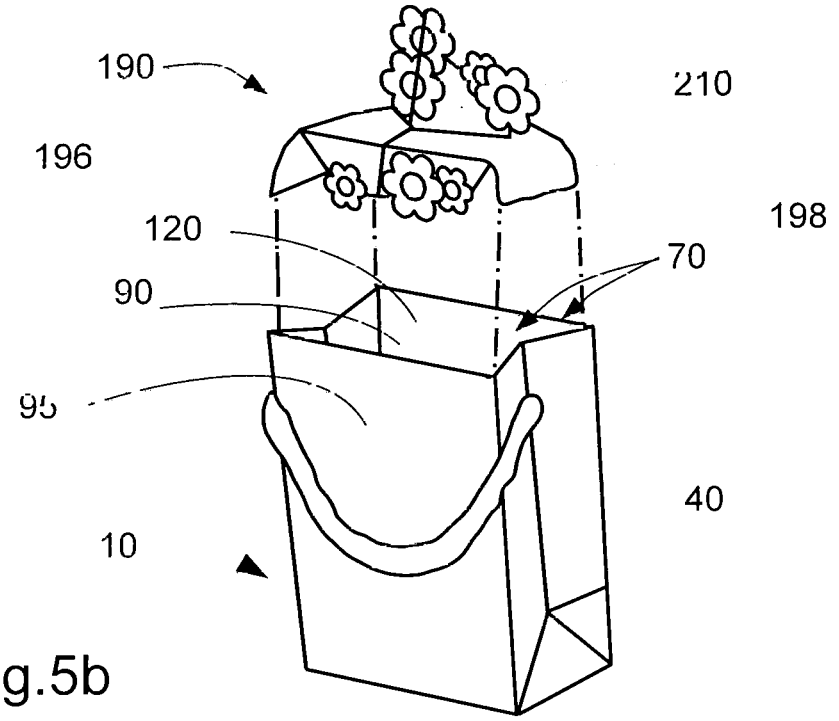
FIG. 5*b* Perspective view of an embodiment of a gift bag, a gift cover and a mounted decoration of the present invention showing an exploded view of the gift cover interfacing with internal and external surfaces of the gift bag showing the front and right sides and top thereof.
Figure 5C:
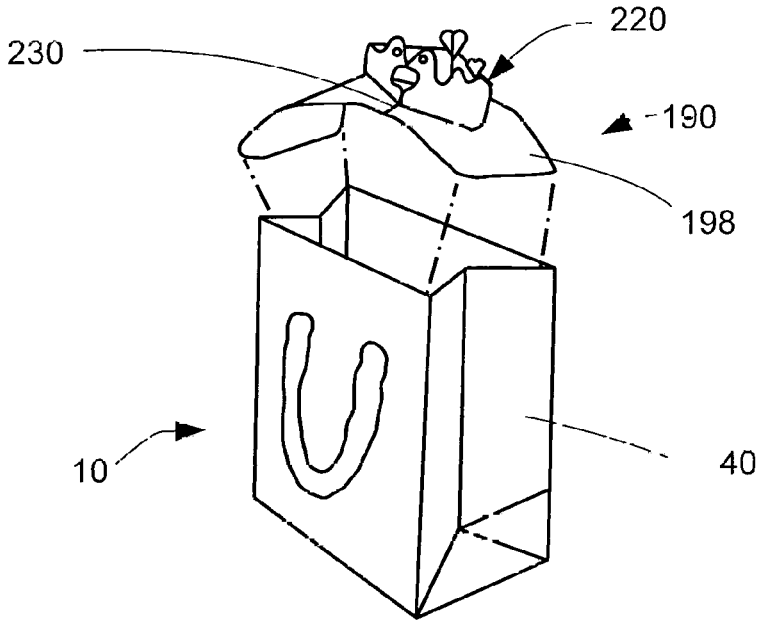
FIG. 5*c* Perspective view of an embodiment of a gift bag, a gift cover and a mounted decoration of the present invention showing an exploded view of the gift cover interfacing with internal surfaces of the gift bag and a locking three dimensional decoration showing the front and right sides and top thereof.
Figure 5D:
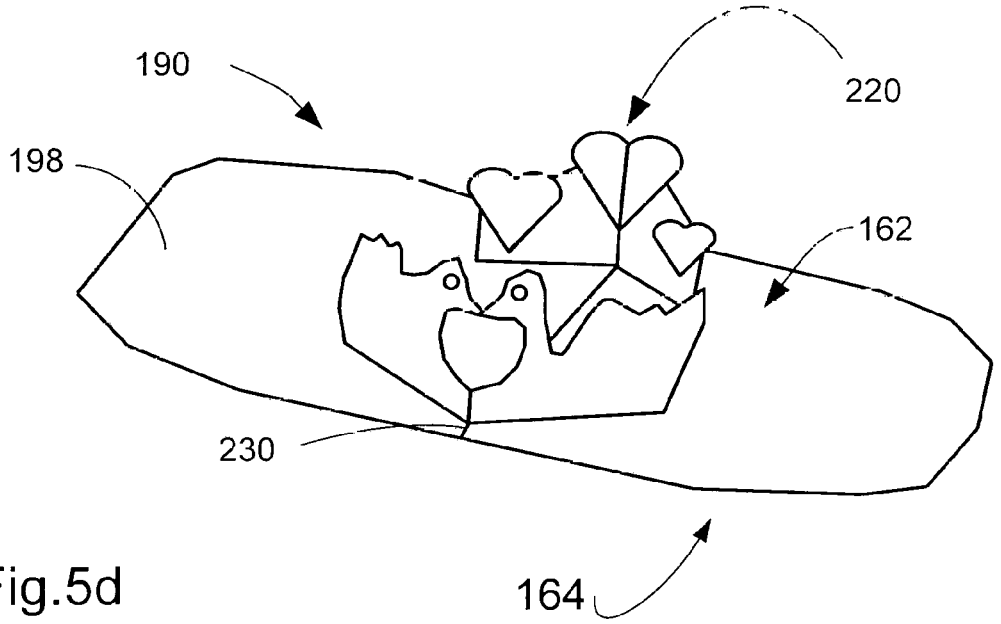
FIG. 5*d* Perspective view of an embodiment of a gift cover of the present inventions showing a view of a locked three dimensional decoration as it interacts with a folded cover showing front and right sides and top thereof.

Discussing in the present invention's cover 190 in general terms, the cover 190 is made out of material like paper, plastic, or card stock as is the gift container 130 and the gift bag 10. Without some structural enhancement, the cover 190, unsupported would not be able to hold heavier decorations, gift cards, greeting cards or similar items that would enhance the gift giving experience as the weight of the additional items would cause the cover 190 to sag or fall into the gift bag interior. The present invention allows the use of much lighter material than the gift bag 10 and will support heavier items on the cover 190. This structural support added by the present invention allows this additional strength in the cover 190 despite the presence of storage creases in the cover 190. If the cover 190 is folded to lay flat within the storage envelope of a gift bag 10 or gift container 130, the storage creases in the cover 190 further weakens the structural integrity of the cover 190 material. As shown in FIGS. 5*a*, 5*b*, 5*c*, and 5*d* these embodiments show improvements to the structural strength of a cover 190. Referring now to FIG. 5*a* shows a primary improvement to a cover 190 for the gift bag 10 that is structurally capable of concealing the gift contained in the gift container, supporting any decorations 210 or functional elements as described in FIG. 5*a* as at least a single set of adhesive/mechanical connection point 206 to connect cover 190 and gift bag 10 that when added to the cover 190, and/or to also utilize the side walls 40 of the gift bag 10, or other functional elements in the gift bag 10 to support the cover 190. In this exemplar, the cover 190 is provided with two creases 201 creating two edge flaps 196 where each creases comprises a structural crease 194. The cover 190 can be made from materials that are less stiff than the gift bag 10 as the structural crease 194 creates a cover 190 that is stiffened. The cover 190 and functional elements 206 provides structural support to the gift bag 10 as the now attached cover 190 extends and open the side walls 40 to their full width of the cover 190. This particular exemplar also has the added benefit of allowing a gift bag 10 to be overstuffed as the adhesive/mechanical connection points 206 as well as the cover 190 structure would contain the side walls 40. FIG. 5*a* accomplishes this by using the exterior surface 95 of the gift bag 10 as well as the opening 60 and the periphery 70 as part of the support structure. Referring now to FIG. 5*b*, this embodiment shows an embodiment of the cover 190 that when deployed creates a structure that supports a decoration 210. This embodiment's cover 190 structure uses a set of edge flaps 196 and a set of bag tabs 198, that when inserted into the gift bag 10, will support, expand, stiffen, and decorate the gift bag 10 simultaneously. Bag tabs 198 may simply be tucked into the side walls 40 interior surfaces 90 or the gift bag 10 may explicitly provide tab mounting slots 199 to insert these bag tabs 198. This embodiment utilizes the interior surface 90 and exterior surface 95 of the gift bag 10 as well as in the periphery 70 to support and hold the cover 190 and decoration 210 above the cavity 120. As shown in FIG. 5*c*, the cover 190 may be configured with a decorative element comprising a three dimensional pop up decoration 220 In some instances, the three dimensional pop up decoration 220 as shown in FIG. 5*c* also supports the cover 190 when deployed. The three dimensional pop up decoration 220 locks the storage crease 230 by creating a structural support This particular embodiment is stronger than an un-creased, resilient sheet of cover material as the three dimensional pop up decoration 220 supports and holds the storage crease 230 in cover 190 open increasing the stiffness of the cover 190 as shown in FIG. 5*d*. The three dimensional pop up decoration 220 is attached to each side of the storage crease 230, an operable distance away from the storage crease 230 so that the cover 190 can collapse to fold flat and compact for storage when the cover 190 is closed. The present invention comprises the use of three dimensional decorations that are hand or spring deployed. Spring deployed is defined as when the three dimensional decoration 220 contains a spring or a material that exerts a spring constant on the decoration to push apart and to hold the V folds of the decoration open, thus "locking" the decoration open. The decoration with a spring deployment is stored in its folded state constrained by some wrapping mechanism.

This exemplar of a cover 190 in this embodiment may also have adhesive seals or other mechanical sealing on its edge flaps, bag tabs 198, edges, or top surface 162 and the bottom surface 164 to enhance the integrity of the completed gift presentation system 370.

Figure 6A:
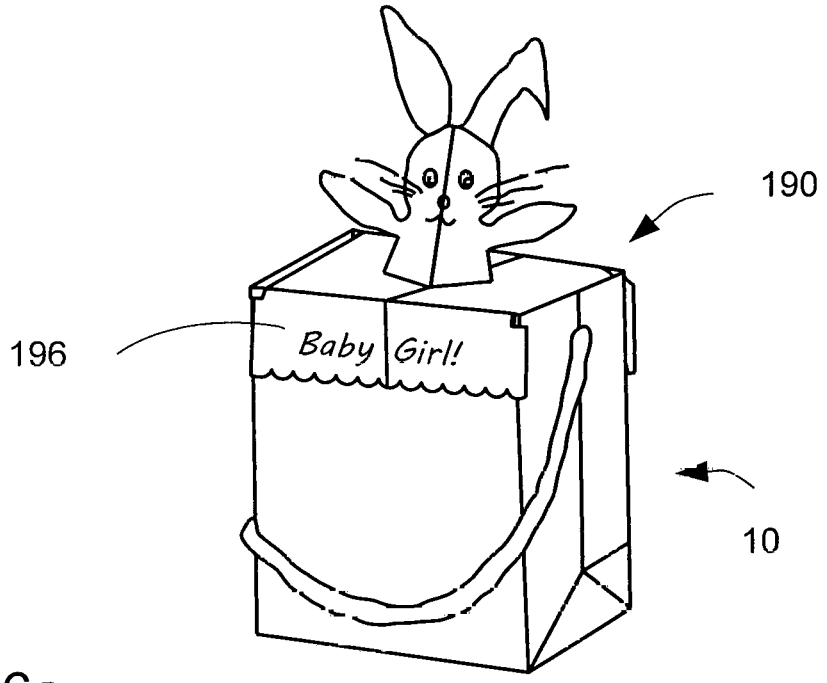
FIG. 6*a* Perspective view of an embodiment of a gift bag, a gift cover and a mounted decoration of the present invention showing an assembled view of the gift cover interfacing with external surfaces of the gift bag with a hidden gift message showing the front and right sides and top thereof.
Figure 6B:
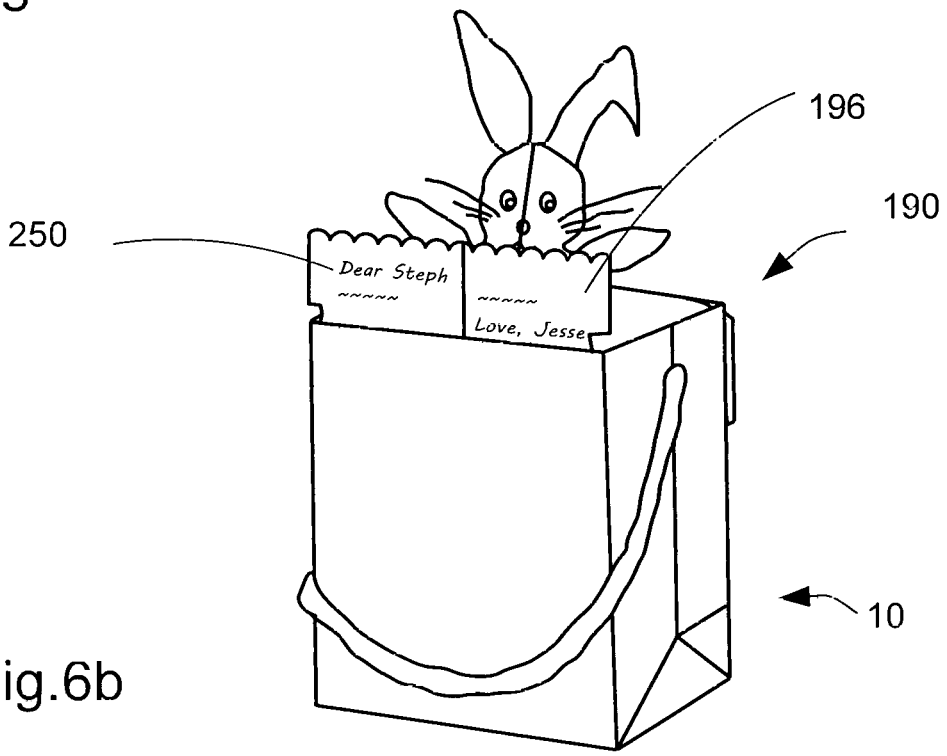
FIG. 6*b* Perspective view of an embodiment of a gift bag, a gift cover and a mounted decoration of the present invention showing an assembled view of the gift cover interfacing with external surfaces of the gift bag with gift message exposed showing the front and right sides and top thereof.

As shown in FIGS. 6*a* and 6*b*, another embodiment of the cover 190 also may serve as a support mount for a greeting card or may in fact as FIG. 6*b* shows, integrate or become the greeting card with the greeting card message 250 concealed by the cover 190 in a closed state as shown in FIG. 6*a* and revealed by lifting or opening the cover 190 as shown in FIG. 6*b*.

Figure 7A:
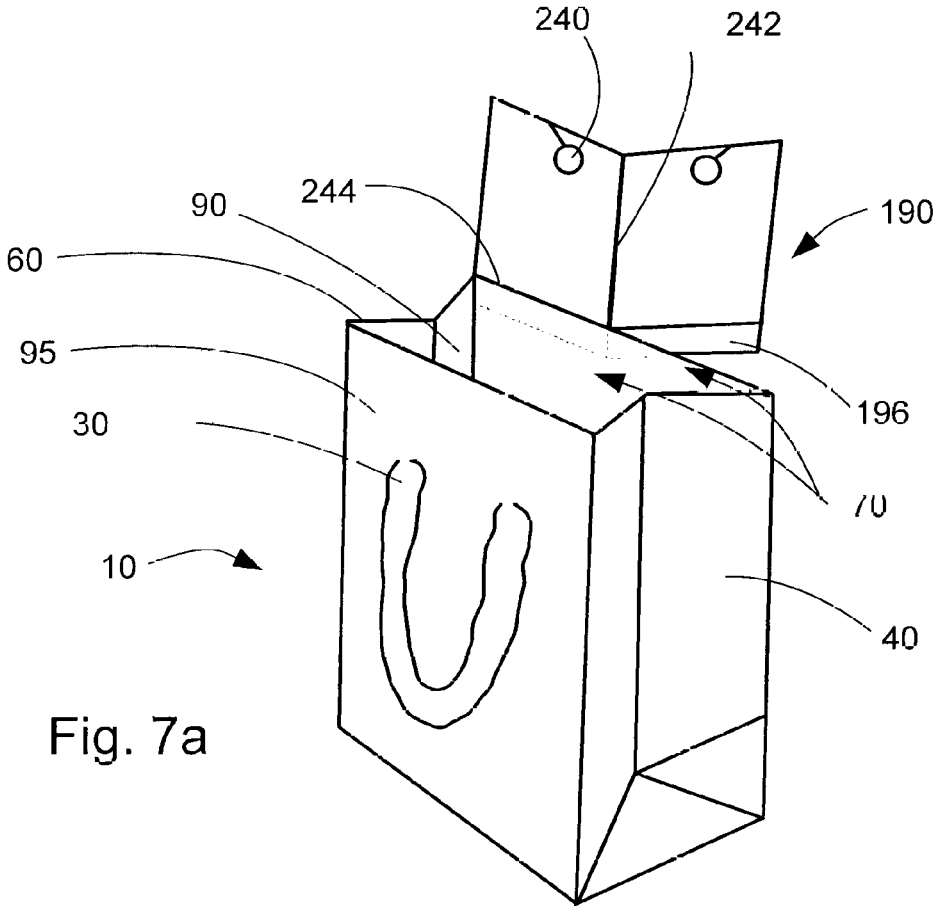
FIG. 7*a* Perspective view of an embodiment of a gift bag and a gift cover of the present invention showing a view of the gift cover deployed from an internally folded position showing the front and right sides and top thereof.
Figure 7B:
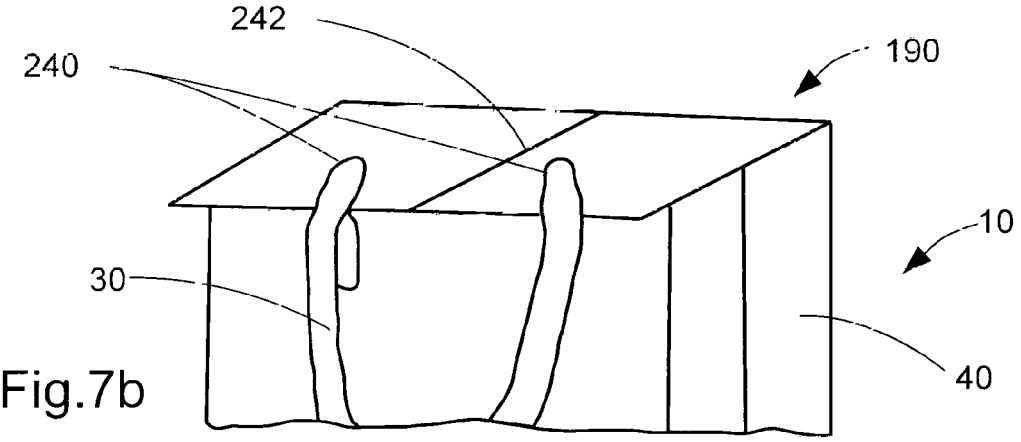
FIG. 7*b* Partial perspective view of an embodiment of a gift bag and a gift of the present invention showing a view of the gift cover closed and locked in place by the gift bag handles showing the front and right sides and top thereof.

As shown in FIGS. 7*a* and 7*b*, another embodiment of the cover 190 may also use available handles 30 to lock the cover 190 to the container by an interference fit, mechanical locking fit (for example a tab or Velcro) or by adhesive applied to an interface between the cover 190 and the handles 30. If the gift bag 10 has handles 30, the handles 30 and the cover 190 could operably connect to secure the cover 190 on the gift bag 10 with a compression connection 240. This embodiment of the cover 190 is designed with a storage crease 242 allowing the cover 190 to store flat and folded with the gift bag 10 and may be stored in the gift bag 10 interior surface 90 or exterior surface 95. The cover 190 is designed with one storage crease 242, which provides an edge flap 196 when deployed where the foldable portion contacts and attaches to the gift bag 10 exterior surface 95 and/or the handles 30 on one side. One half of the cover 190 folded portions are operably attached to one half of the gift bag 10 exterior surface 95 of side wall 40 along periphery 70. When the cover 190 is opened, the unfolded portion of the cover 190 creates a structural crease 244 supports an edge flap 196 that stiffens the storage crease 242 of cover 190, holding and extending open the storage crease 242 when the cover 190 is deployed. The cover 190 then spans the gift bag 10 opening 60 where the cover 190 comprises a compression connection 240 that fastens to the gift bag 10 handles 30 providing structural support to the gift bag 10 as the secured cover 190 holds the upper edges of the gift bag 10. Therefore, the secured cover 190 becomes a stiffener as the cover 190 width stiffens the side walls 40, extending and opening the side walls 40 to maximize gift capacity.

Figure 8A:
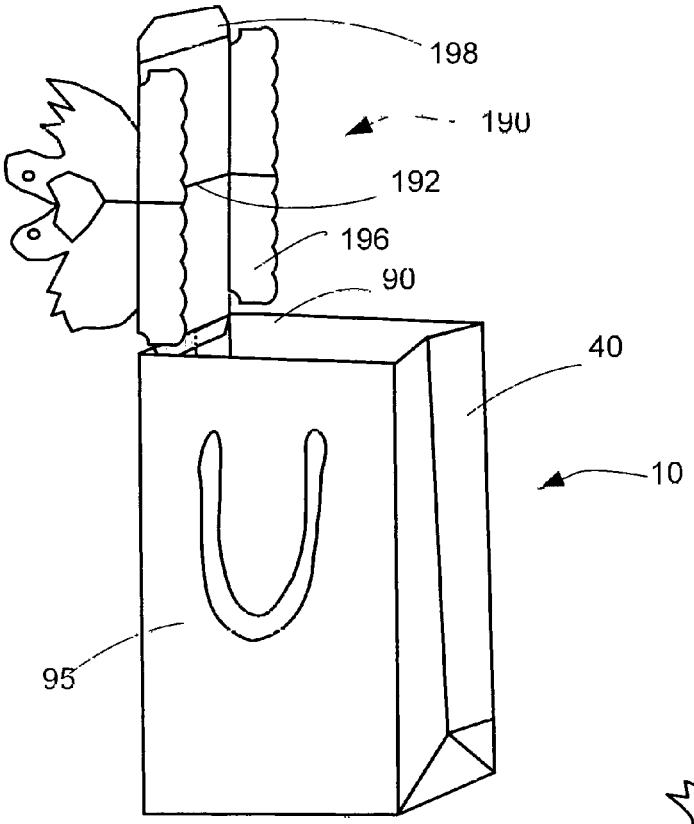
FIG. 8*a* An orthogonal view of an embodiment of a gift bag, a gift cover and a mounted decoration of the present invention showing a view of the gift cover deployed from an internal folded position, the cover operably affixed to a portion of gift bag's internal side wall, showing the front and right sides and top thereof.
Figure 8B:
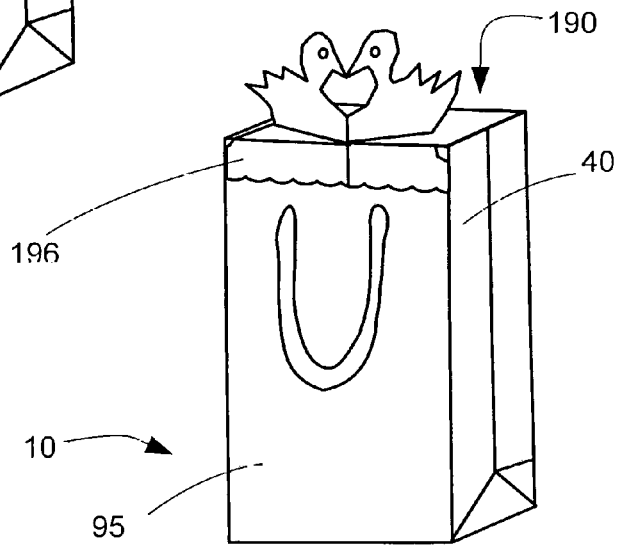
FIG. 8*b* An orthogonal view of an embodiment of a gift bag, a cover and a mounted decoration of the present invention showing a view of the cover in a closed and sealed position, the cover operably affixed to a portion of gift bag internal side wall and supporting the cover with downward edge flaps over hanging and inserted bag tabs, showing the front and right sides and top thereof.

The present invention also comprises a plurality of ways to attach or seal the cover 190 to the gift bag 10 as shown in FIGS. 8*a* and 8*b*. The methods of connecting a cover 190 to a gift bag 10 in this embodiment comprises; connecting the cover 190 and the gift bag 10 with interference fits on certain sides of the cover 190 and the side walls 40, providing an edge flap 196 (a structural fold) on side walls 40 where the cover 190 is supported by certain edges of the gift bag 10, or providing an overlapping bag tab 198 on the cover 190 that folds inside the interior surface 90 the side wall 40 of the gift bag. These may be used in conjunction with each other as well as independently. In the case of the edge flap 196 folding outside the exterior surface 95 of the gift bag 10, the connecting means comprise a variety of methods, at least a single storage crease 192 locating the cover 190 over the top of the gift bag 10, the cover 190 affixed with a mechanical means (i.e., mechanical sealing by interference fits, interacting tabs or mechanical attachments, mechanical fasteners such as hook and loop fabric, or hinges) or adhesive means (i.e. adhesive strips) to fasten the cover 190 to the gift bag 10 exterior surface 95 or interior surface 90 of the side walls 40, and other well-known methods of joining paper and fiber based materials.

Figure 9:
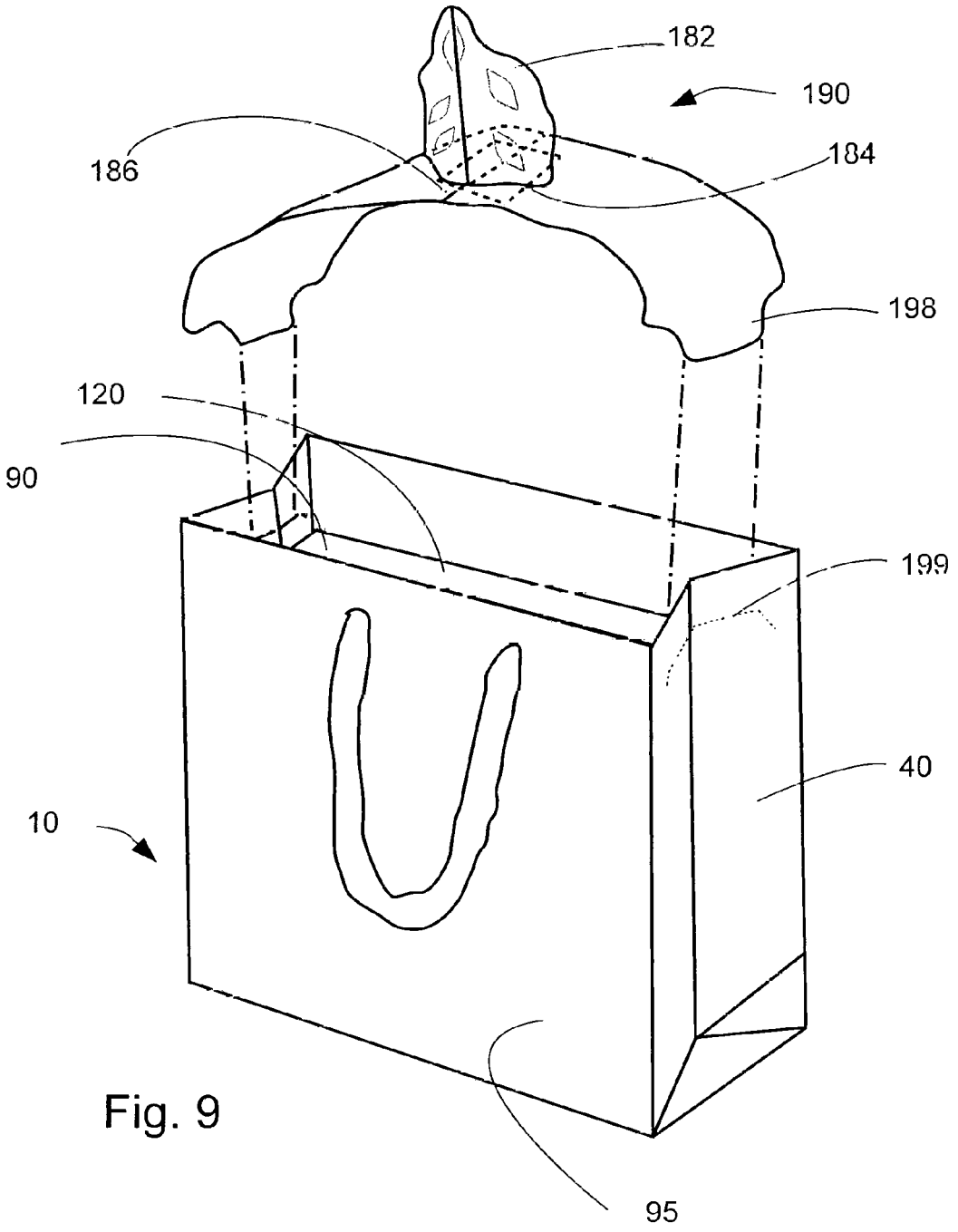
FIG. 9 Perspective view of an embodiment of a gift bag, a gift cover and a mounted decoration of the present invention showing an exploded view of the gift cover and gift bag, the cover operably affixed to a portion of the opposed gift bag internal side walls and supporting the cover and the decoration with a structural arch, showing the front and right sides and top thereof.

FIG. 9 shows an embodiment a cover 190 that inserts via mechanical tabs in the side walls of the gift bag 10. The cover 190 combines a structural improvement to both the gift bag 10 and the cover 190. In this exemplar, the cover 190 is designed with a three dimensional pop up V-fold decoration 182, a stiffening member 184, which stiffens the storage crease 242. Additionally, the cover 190 is designed with bag tab 198. The stiffening member 184 can either be an integral part of the three dimensional pop up V-fold decorations 182 that locks into place, or it could be as simple as a retail hanging tab as described later in this specification. Where the cover 190 length is longer than the gift bag length and sufficiently long enough to insert and hold the bag tabs 198 in the tab mounting slots 199 found on the side walls 40. The resultant cover 190 extends and holds open at least the side walls 40 of the gift bag 10, thereby stiffening the gift bag 10. The cover 190 forms a seal and conceals the gift within the gift bag 10 that is stiffened and allows the full capacity of the cavity 120 of the gift bag 10 to be utilized if so desired. Furthermore the bag tabs 198 on the cover 190 could be designed with an adhesive where the adhesive bag tab secures to the tab mounting slots 199 or the bag tabs 198 can fasten directly to the side walls 40 of the gift bag 10 without tab mounting slots 199. The value of the stiffening member 184 and the bag tab 198 and tab mounting slot 199 in the present invention, is if the gift bag 10 is stuffed with gifts and the side walls 40 distort, the cover 190 could not shift and fall down as wall interference fit with the cover 190 changes. In this design, the cover 190 can be stored within the gift bag 10 interior surfaces 90. Alternatively it could store along the gift bag 10 side wall 40 exterior surfaces 95 to fold flat and compact during storage.

Figure 10A:
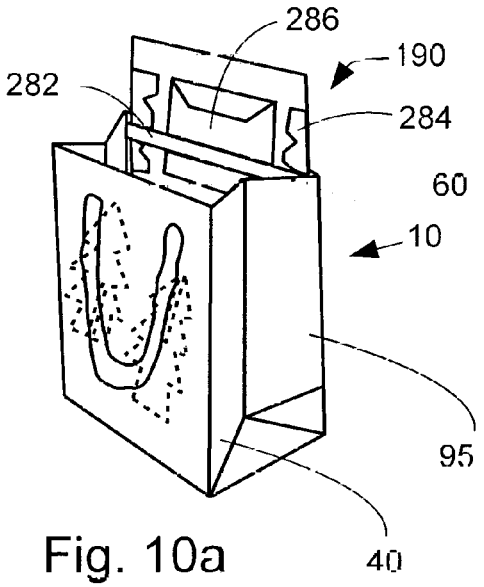
FIG. 10*a* Perspective view of an embodiment of the present invention showing a gift bag, a deployable cover with a compartment for a secondary gift, cover retained by a retention cuff and a gift bag mounted construct of the present invention showing a deployed view of the cover and gift bag, the cover moveably affixed to a portion gift bag internal side wall, showing the front and right sides and top thereof.
Figure 10B:
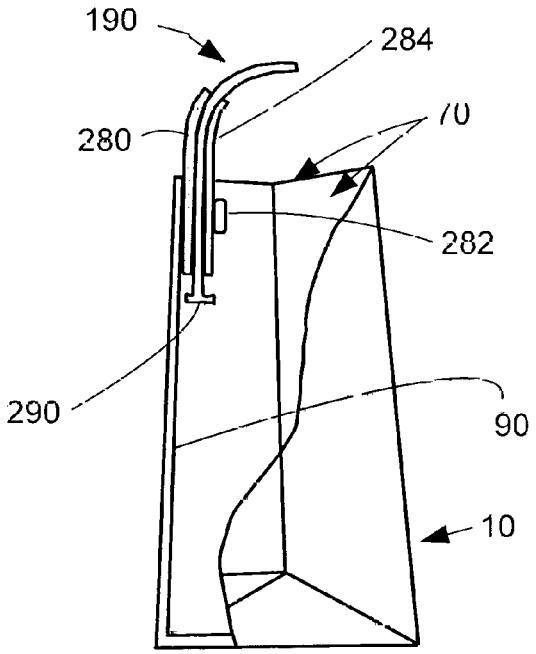
FIG. 10*b* Side cut away view of an embodiment of a gift bag, a cover with a compartment for a secondary gift, an anti-peek flap and a deployable decoration of the present invention showing the cover moveably affixed to a portion of gift bag internal side wall, showing the left sides thereof.
Figure 10C:
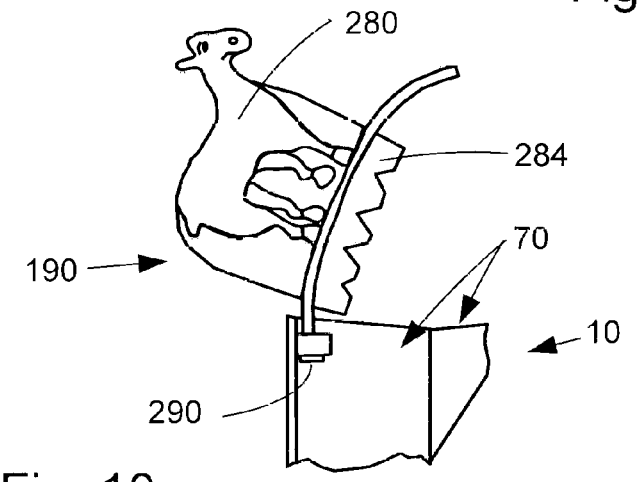
FIG. 10*c* Side cut away view of an embodiment of a gift bag, a gift cover with a compartment for a secondary gift, an anti-peek flap and a deployable decoration of the present invention showing the cover moveably affixed to a portion of gift bag internal side wall, a deployed decoration and a deployed anti peek panel, showing the left sides thereof.

As shown in FIGS. 10*a*, 10*b*, and 10*c* the cover 190 also may be stored and deployed from an attached area of the gift bag 10. In this embodiment, the cover 190 is deployed from the interior surface 90 of the gift bag 10. Cover 190 may take the form of a flexible single sheet or a cover 190 that has a tambour styled construction that is attached either to the exterior surface 95 of the side wall 40 of the gift bag 10 or the interior surface 90 of the side wall 40 of the gift bag 10. This cover 190 and its tambour style is defined as a cover 190 comprising a plurality of linear rigid strips of cover material having top and bottom surface with each top and bottom surface of rectangular transverse rigid strip placed in abutting side-by-side relationship including a flexible backing material overlaying and adhesively secured to the back surfaces of the linear rigid strips of cover material. Referring to FIG. 10*a* and cutaway FIG. 10*b*, the cover 190 comprises a cuff 282 that retains the cover 190 and allowing it to be deployed while a stop 290 attached to the back edge of the cover 190. This cuff 282 attached to the gift bag 10 and moveably attached to the cover 190 ensures that the cover 190 remains attached to the gift bag 10. As shown in FIG. 10*c*, the cover 190 in this exemplar also comprises at least a single deployable decoration 280 attached to the cover 190 to deploy once the cover 190 is deployed. The cover 190 also comprises anti peek flaps 284 that deploy downward as they pass above the cuff 282. The anti-peek flaps 284 also act as downward edge flap 196, stiffeners. The cover 190 also comprises a compartment 286 operably attached to the bottom surface 164 of the cover 190. Once deployed, the cover 190 would then attach to the periphery 70 of the gift bag 10 and comprise attachment points (adhesive or mechanical) at the front of the cover 190 and the anti-peek flaps 284 to the gift bag 10 interior surface 90 or exterior surface 95. Inserting a secondary gift or greeting card into the compartment 286 would help support and stiffen the cover 190 as it is deployed and attached to the gift bag 10 to seal the opening 60 of the gift bag 10 once the gift has been placed inside the gift bag 10. By stiffening the cover 190 with other items comprising, anti-peek flap 284, compartment 286, the cover 190 may be made out of less resilient materials and yet remain securely fastened and support cover 190.

Figure 11A:
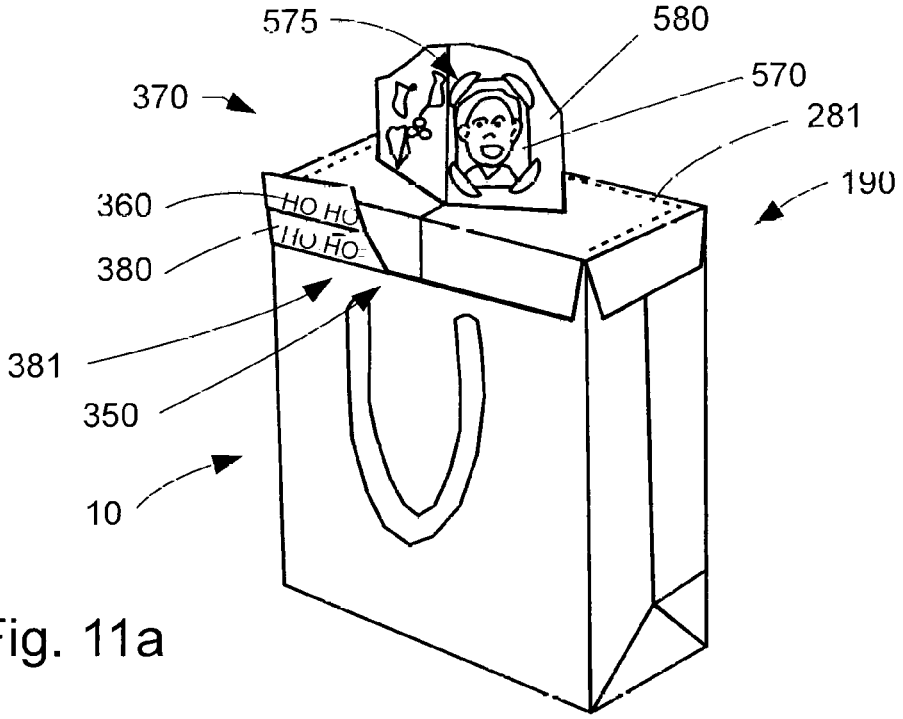
FIG. 11*a* Perspective view of an embodiment of the present invention showing a gift bag, a sealed gift cover with anti-tamper message and a detachable mounted decoration containing a photo and a pop-up display suitable for remounting, showing the front and right sides and top thereof.
Figure 11B:
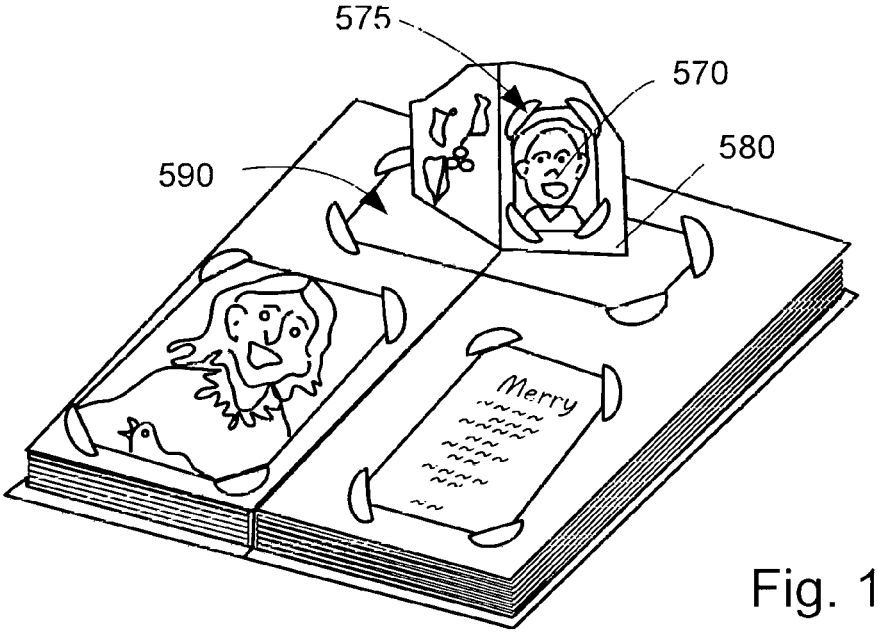
FIG. 11*b* Perspective view of an embodiment of the present invention, showing a detachable mounted decoration containing a photo and a pop-up display remounted in a photo album FIG. 12*a* Perspective view of an embodiment of the present invention showing an exploded view of a gift bag, a gift cover with functional element structural envelope and gift card mounting area underneath the cover and a detachable mounted decoration, showing the front and left sides and bottom thereof FIG. 12*b* Bottom view of an embodiment of the present invention showing sealed structural envelope and gift card area.

As shown in FIGS. 11*a* and 11*b*, the cover 190 also comprises a plurality of secondary uses beyond covering the gift bags 10 or gift containers 130. The cover 190 may detach and become a decoration 590 in combination with a three dimensional pop up display 580 affixed to the cover 190. The cover 190 may by itself or in combination with the gift bag 10 or other functional elements associated with the present invention can be mounted in a photo album or scrapbook and oriented to pop up when the page is opened. (as described later in the specification and in FIGS. 11*a-d*)

Exemplars of a Greeting, Gift, or Gift Card as Functional Elements

Figure 12A:
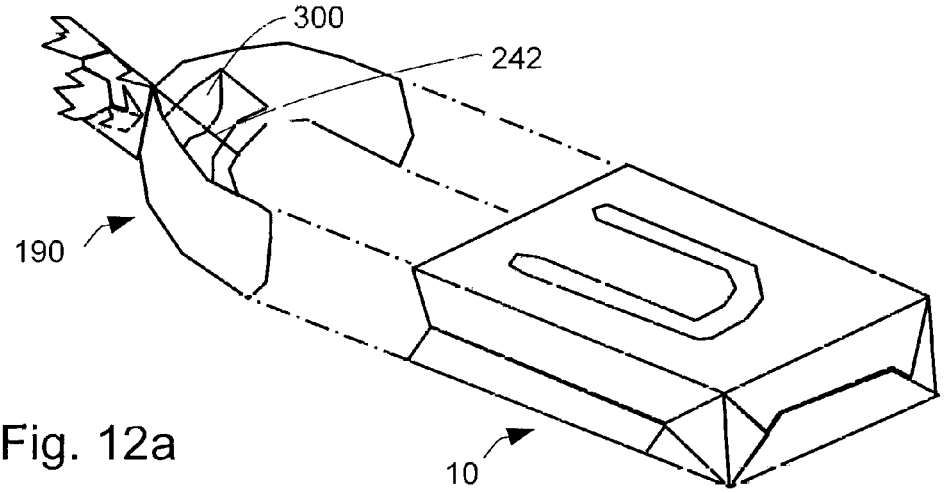
FIG. 12*c* Bottom view of an embodiment of the present invention showing sealable structural envelope with a gift card being inserted into the area.
Figure 12B:
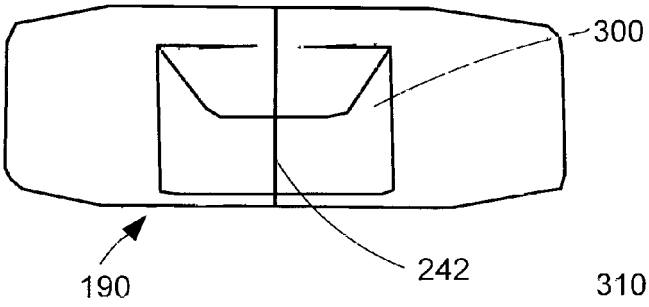
Figure 12C:
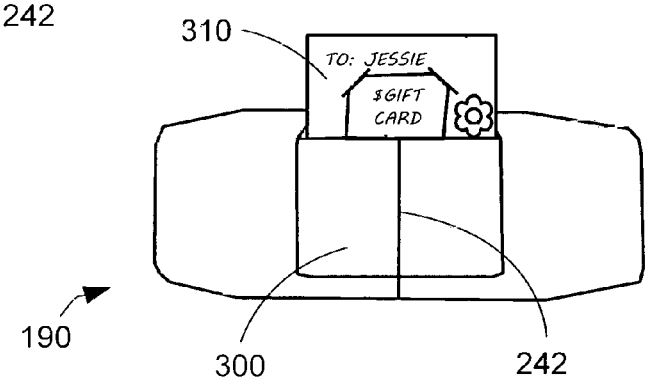

In the case of FIGS. 12*a*, 12*b*, and 12*c*, the cover 190 is combined with a compartment 300 to hold a secondary gift 310 (like a gift card or greeting card). This cover 190 is designed to be folded during storage. As the resiliency of the secondary gift 310 is significantly greater than a cover 190, the secondary gift 310 becomes a functional element stiffening the storage crease 242 and allowing the cover 190 to be placed and held in a arching configuration replacing the need to have a more resilient material for the cover 190 or cover 190 that has been pre-folded and creased for presentation and display. As shown in FIG. 12*b*, this compartment 300 may be as simple as an envelope where the envelope may be designed to be sealed with removable or permanent adhesives or mechanically sealed. The present invention also comprises embodiments that would hold more substantial gifts such as candy bars by providing for an expanded and reinforced compartment and cover 190. Another embodiment of this concept comprises a cover 190 that is pre folded having a storage crease is designed to receive a gift tag 200 into a mounting slot 195 cut in the cover 190. The mounting slot 195 cut would generally intersect the storage crease and extend a distance to either side of the storage crease. The mounting slot 195 cut comprises a retaining pocket to receive the decoration. When the decoration mounts into the mounting slot 195 cut, the greeting decoration extends and holds open the retaining pocket thereby supporting the storage crease to open and extend the storage crease and stiffen the cover 190. This embodiment would also comprise a cover width and length sufficient to maximize the cavity as well as support the cover 190 when inserted into the periphery 70.

Exemplar of Improvements to the Gift Bag or Container

In the present invention, the gift bag 10 or gift container 130 also serves as a platform for adding improvements for enhancing the gift presentation value as well as being augmented by the addition of functional or decorative elements. A decorative element is defined as a decoration or other related decorative attachments that have primarily a decorative function that attaches to the cover 190, gift bag 10 or gift container 130 but in combination with at least one or more of cover 190, gift bag 10 or gift container 130 may provide secondary functions such structural improvement of the integrity of the gift presentation, or display of hidden messages or mounting points for other items (i.e. an edge flap 196 that has a die cut decorative shape).

As described in the improvements to the cover section of this detailed description, enhancing the presentation value of the gift is one of the paramount functional improvements. Containers in this invention can also carry decorations, deploy messages, hide secondary gifts, maximize the space necessary for the gift inside and allow the designer to make the containers useful beyond the its normal functional use of holding a gift.

Exemplar of Structural Improvements to the Gift Bag or Gift Box

Generally, the gift bag 10. or gift container 130 improvements comprise distinct improvements to the shippable nature of the decorated gift, mounting areas for structural support or deployment of the cover 190 if attached, and the addition of various slots, tabs, mechanically or adhesively attached functional elements that may be used to re-articulate the gift bag 10 or gift container 130 after the gift is given. The improvements for shipping are accomplished by creating the gift container 130 with pre-decorated materials that have properties that approved for use in shipping. Examples of this type of material would comprises corrugated cardboard, coated corrugated cardboard, Mylar®, Tyvex® or other polymer based coatings/films used for the standard container materials with the material pre-decorated with inks or other media that are designed or ruggedized to withstand shipping handling. The gift container 130 may also be improved by adding strengthened corner pieces on the gift container as well as addition of linered adhesive strips to seal the gift container 130 coupled with tear strips that allow easy access to the gift container 130. A tear strip is defined as a device that is either made up of plastic tape applied to the inside of the gift container 130 during manufacture, which enables the sealed gift container 130 to be opened quickly by pulling the tape through a predefined area of the gift container 130. The same effect for easy opening can be achieved using perforations in a pattern.

Figure 13A:
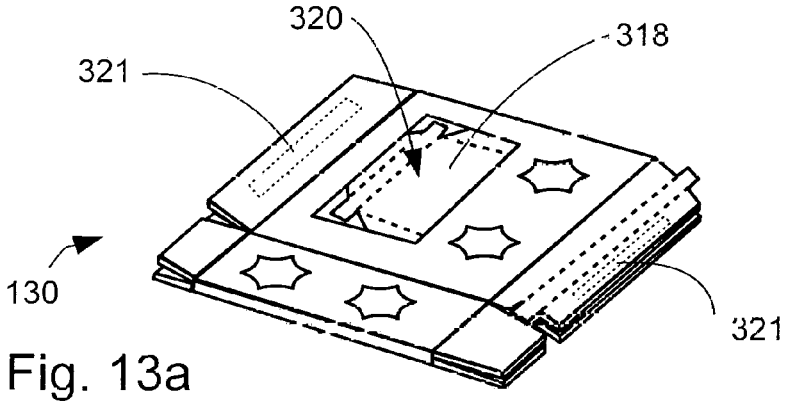
FIG. 13*a* Perspective view of an embodiment of the present invention comprising a collapsible gift box, an integrated gift cover with a compartment for a secondary gift and a deployable decoration comprising a mountable gift tag showing a predeployed view of the gift box and cover, showing the front and right sides and top thereof.
Figure 13B:
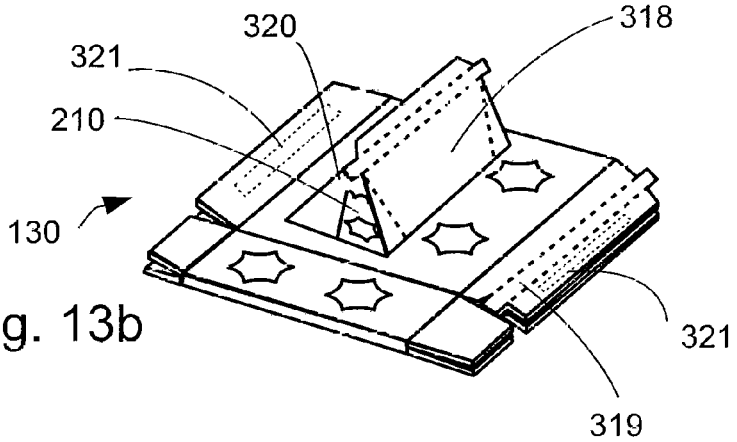
FIG. 13*b* Perspective view of an embodiment of the present invention comprising a collapsible gift box, an integrated gift cover with a compartment for a secondary gift and a deployable decoration comprising a mountable gift tag showing a deployed view of the compartment for a the secondary gift, decoration, or gift tag, showing the front and left sides and top thereof.
Figure 13C:
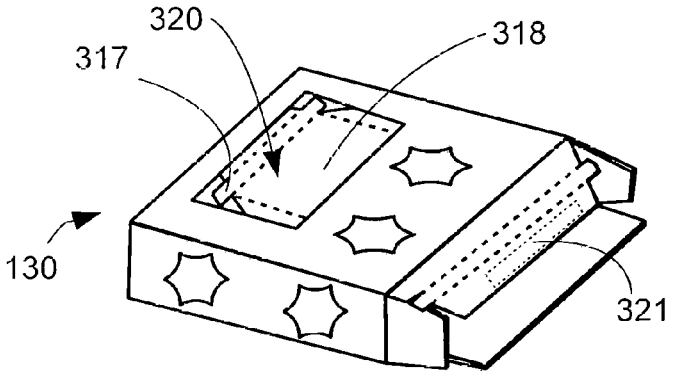
FIG. 13*c* Perspective view of an embodiment of the present invention comprising a collapsible gift box, an integrated gift cover with a compartment for a secondary gift and a deployable decoration comprising a mountable gift tag showing a deployed view of the gift box ready for gift insertion, a resealed compartment for the gift card, decoration and gift tag, showing the front and left sides and top thereof.
Figure 13D:
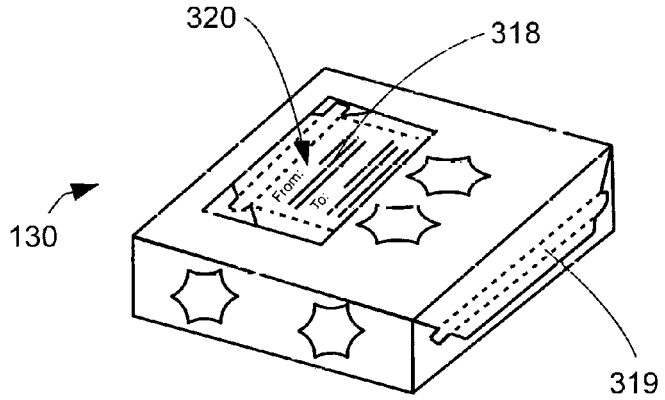
FIG. 13*d* Perspective view of an embodiment of the present invention comprising a collapsible gift box, an integrated gift cover with a compartment for a secondary gift and a deployable decoration comprising a mountable gift tag showing a sealed view of the gift box, a sealed compartment for the gift card, decoration and gift tag ready for shipping, showing the front and left sides and top thereof.
Figure 13E:
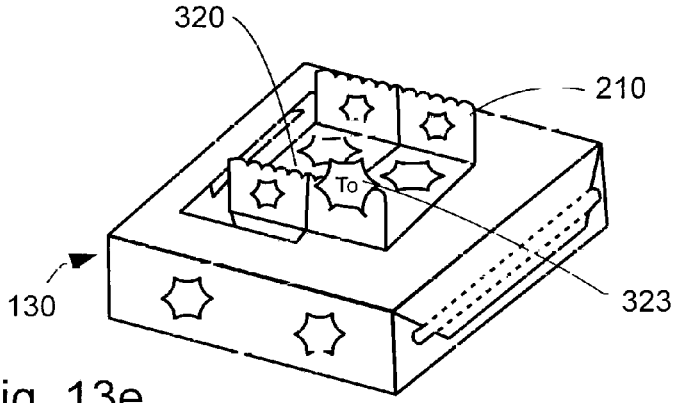
FIG. 13*e* Perspective view of an embodiment of the present invention comprising a collapsible gift box, an integrated cover with a compartment for a secondary gift and a deployable decoration comprising a mountable gift tag showing a received and ready to open view of the gift box, a deployed decoration, and a mounted gift tag, showing the front and left sides and top thereof.
Figure 13F:
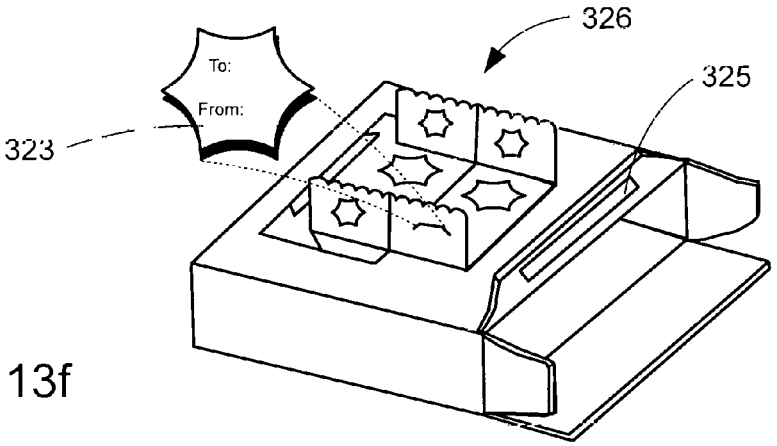
FIG. 13*f* Perspective view of an embodiment of the present invention comprising a collapsible gift box, an integrated cover with a compartment for a secondary gift and a deployable decoration comprising a mountable gift tag showing a opened view of the gift box, a deployed decoration, and a removed gift tag, showing the front and left sides and top thereof.
Figure 14A:
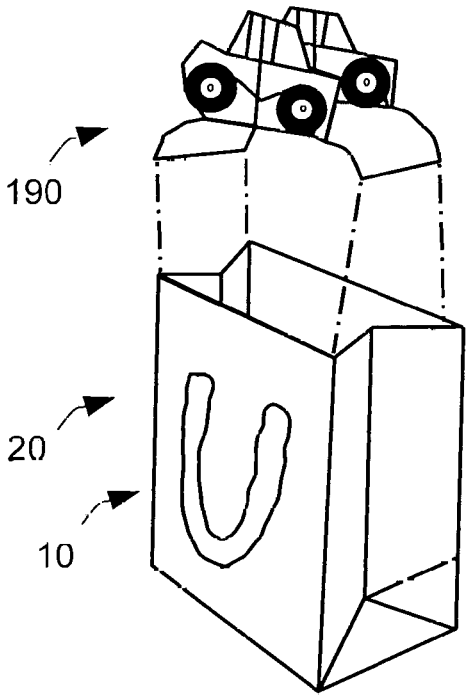
FIG. 14*a* Perspective view of an embodiment of the present invention showing a gift bag, a gift cover with a toy car decoration of the present invention showing an exploded view of the gift cover and gift bag, the cover, showing the front and right sides and top thereof.
Figure 14B:
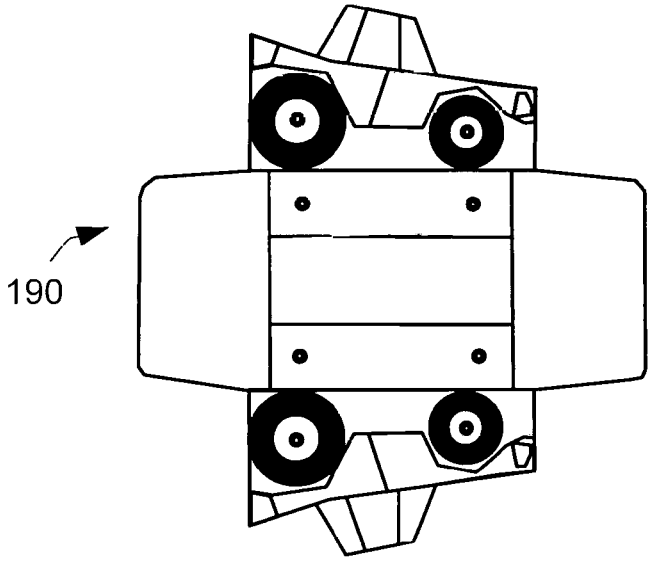
FIG. 14*b* Template view of an embodiment of the toy car cover comprising separable components of car, wheels, and chassis FIG. 14*c* Exploded view of an embodiment of the toy car cover components comprising car body, wheels, car chassis, and axles FIG. 14*d* Perspective view of an embodiment of the present invention showing a re-articulated gift cover transformed to a toy car, showing the front and right sides and top thereof.
Figure 14C:
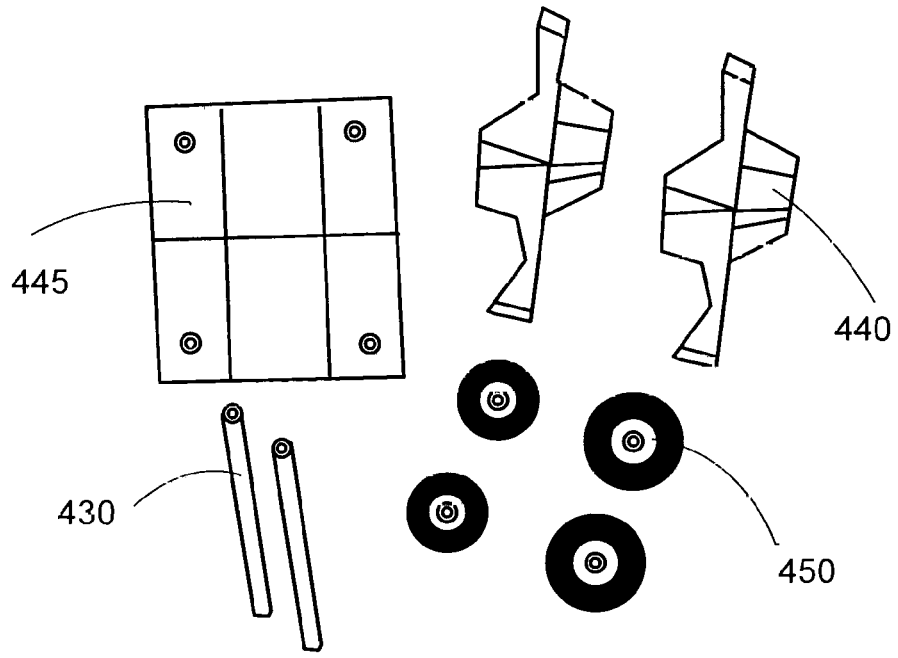
Figure 14D:
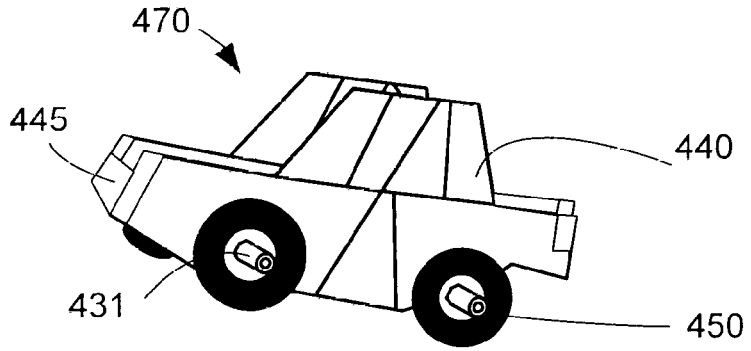

As shown in FIG. 13*a* through FIG. 13*f*, a gift container 130 in form of a collapsible box sealable with linered adhesive strips 321 is shown with a deployable decoration 280 that comprises a hidden message 360 or greeting to the gift recipient that is hidden. More specifically, in FIGS. 13*a* and 13*b*, the gift container 130 shows a compartment 320 sealable with linered adhesive strips 321 and a box cover 318 in the gift container 130. This compartment 320 allows the gift giver to conceal at least a secondary gift that the gift recipient may access separately from the gift container 130. The sequence of FIGS. 13*a*-13*f* show the gift container 130 folded flat (13*a*), articulated into a ready configuration, accessing the compartment 320, (as shown in FIG. 13*b*), gift insertion (as shown in FIG. 13*c*) the gift container 130 ready for shipment (13*d*), receipt of gift as shown in FIG. 13*d*), the articulation of compartment 320 upon receipt, allows deploying of the decoration 210, (As shown in FIG. 13*e*) and the mounting of additional displays that may also be stored in the compartment 320 during shipping that would enhance the presentation of a gift. Reuse of the gift container 130 for a second gift giving of a different gift to another recipient (As shown in FIG. 13*f*). The gift and a secondary gift are accessed by using tear strips 319 and 317 respectively. For the purpose of clarity, the compartment 320 comprises sufficient space to hold at least a gift tag 323, gift card, a greeting card, a prepaid gift card, the decoration 210 or additional decorations comprising three dimensional pop up decorations 220 would be arranged or attached to the gift container 130 for presentation of the gift. Removing the gift tag 323 will allow the gift container 130 to be resealed with an unused linered adhesive strip 325 and reused as a gift package 326.

Exemplars of General Enhancements to Overall Gift System

A number of improvements may be made to either or both of the gift containers (box or bag) and are addressed here in the detailed description Exemplars of Anti-Tampering or Hidden Message Improvements to the Gift System In this embodiment of the gift presentation system 370 shown in FIG. 11*a*, the cover/bag interface area has an anti-tampering feature 350 or a feature that displays a hidden message 360 when the gift presentation system 370 is opened. The purpose of the anti-tampering feature 350 is to tell a viewer of the gift bag 10 as to whether all or part of the cover 190 has been removed or the gift inside has been accessed. This anti-tampering feature 350 may comprise adhesive tape 380 that separates and leaves evidence of an attempted surreptitious opening of the gift presentation system 370. This adhesive tape 380 comprises application via a linered adhesive strip that would be removed prior to sealing the gift bag 10. Examples of this type of adhesive tape 380 are manufactured by the NovaVision Corporation, Bowling Green, Ohio. Additional methods of accomplishing this feature may be accomplished by the inclusion of a color changing ink in the adhesive that changes color when the cover 190 is opened or tampered in the same manner of the anti-tampering adhesive tape. Yet another method might be to have a sacrificial paper layer comprising an anti-tampering message layer on the gift container 130 that would be left attached to the cover 190 if the gift container 130 was tampered with. As shown in FIG. 11*a*, another facet of the anti-tampering feature 350/hidden message 360 cover 190 is to display to the person attempting to open the cover 190 or the gift bag 10 or the gift container 130 a hidden message 360 that could be whimsical or entertaining directed to the person attempting to open the gift container 130 or gift bag 10.

Various embodiments of this cover 190 would comprise most standard versions of this invention's covers including attached, severable and deployable covers. Another embodiment of the hidden message feature would to enable a message to appear in an adhesive layer sealing the cover 190 to the gift container 130. This embodiment comprises similar construction methodology to that of the anti-tampering feature 350, but here the purpose here is designed to offer greetings or encouragement to the gift recipient at each stage of the gift presentation. An exemplar of how this is accomplished is to design the adhesive layer joining the cover 190 and the gift container 130 to cohesively split to display, a hidden message on the gift container 130, intended to prevent tampering in an entertaining manner. An example for a Christmas theme would be a "Ho, ho, ho!" a whimsical or entertaining hidden message 360, or a greeting 362 lining the adhesive area 381 of the cover-gift container interface as shown in FIG. 11*a*. The cover-gift container interface may also contain a perforated line 281 by which to access the gift bag 10.

Exemplars of Improvements to the Gift Presentation System that Embody a Separate Secondary Function after its Primary Use as a Gift Presentation System As shown in FIGS. 11*a* and 11 *b* and other subsequent FIGS. 13-16, other exemplars of the present inventions is a secondary usage after the gift has been removed from the gift bag 10 or gift container 130 are listed. For example after use as a gift wrapping, the gift container 130 and cover 190 can be re-articulated to become a gift such as a multidimensional display, toy, puzzle party game, table display, luminary, ornament or other types of displays. When the cover 190 is affixed to the gift container 130, the gift container 130 may be configured to hang and become a hanging ornament, or game such as a piñata. Examples of these embodiments of the present invention comprise:

Toy Car and Race Track:

As shown in FIG. 14*a*, 14*b*, 14*c*, 14*d*, the re-articulation of the gift bag 10, the cover 190, and straws 430 into car body 440, car chassis 445, wheels 450, and axles 431. This rearticulation into a toy can be accomplished by having the gift bag 10 pre-stenciled with either cutting lines or micro-perforations on the gift bag 10 or the cover 190 for the user to detach from the gift bag body 20 to assemble the toy from the component parts. Here a race car 470 is created by detaching the race car body 440 the car chassis 445 and wheels 450 from the cover 190, adding two drinking straws 430 to use as axles for the car toy, and reassembling the car body 440, car chassis 445 rolling wheels 450 and drinking straw axles 431 to create the car 470. If desired a race track may also be stenciled into the gift bag 10 to be cut out and assembled.

Figure 15A:
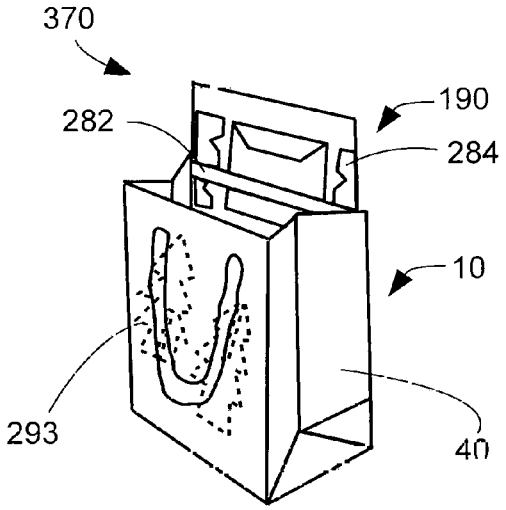
FIG. 15*a* Perspective view of an embodiment of the present invention showing a gift bag, a deployable gift cover with a compartment for a secondary gift, the cover retained by a retention cuff and a gift bag mounted construct of the present invention showing a deployed view of the gift cover and gift bag, the cover moveably affixed to a portion gift bag internal side wall, showing the front and right sides and top thereof.
Figure 15B:
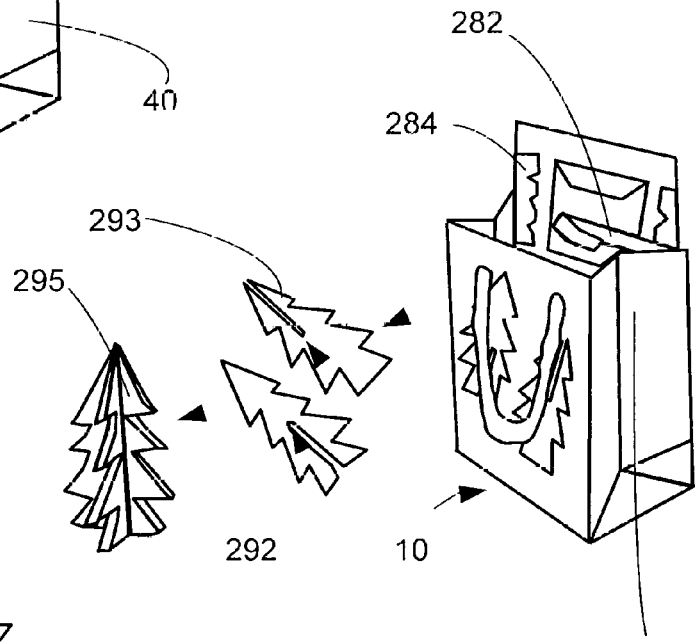
FIG. 15*b* Perspective view of an embodiment of the present invention showing a gift bag, a deployable gift cover with a compartment for a secondary gift, the cover removable by removed retention cuff and a three dimensional construct removed from gift bag and assembled, of the present invention showing a post opened view of the gift cover and gift bag, the cover detachably affixed to a portion gift bag internal side wall, showing the front and right sides and top thereof.
Figure 15C:
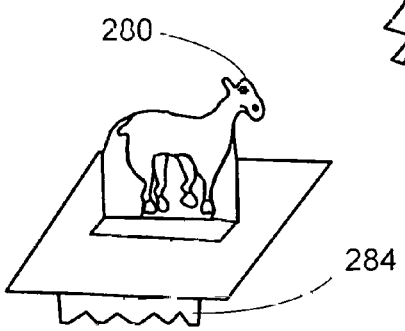
FIG. 15*c* Perspective view of removable decoration comprising diorama, backdrop, figure, or table display, showing front and right sides and top thereof.

Decorative Package Display, Diorama and Storage. As shown in FIGS. 15*a*, 15*b* and 15*c*, this embodiment of the present invention provides a multi-use version of the gift presentation system 370, as presented also in FIGS. 10*a*, 10*b*, and 10*c*, that re-articulates into two and three dimensional play displays and/or a diorama backdrop to place the constructs in context with the theme of the gift container 130. This embodiment may also comprise a three dimensional construct that is free standing or interacts with the other constructs or the gift itself. Examples of three dimensional constructs would comprise animals, birds, people, buildings etc. For example, in FIG. 15*a*, a two Christmas tree constructs 293 is shown attached to the side walls 40 of the gift bag 10. In FIG. 15*b*, removing the two Christmas tree constructs 293 and inserting the slot 292 on each construct 293 with the slot 292 on the other construct 293 creates a standing three dimensional outline of a Christmas tree 295. As shown in FIG. 10*c*, and FIG. 15*c*, the deployable decoration 280 and cover 190 are removed by detaching the cuff 282. Once removed, the deployable decoration 280 comprises stands that were initially the anti-peek flaps 284 and may be used as a diorama to play with the various constructs. Other embodiments of constructs would use various slot and tab inserts to allow many different configurations of multidimensional display to be mounted in many eye-catching and pleasing arrangements.

Figure 16A:
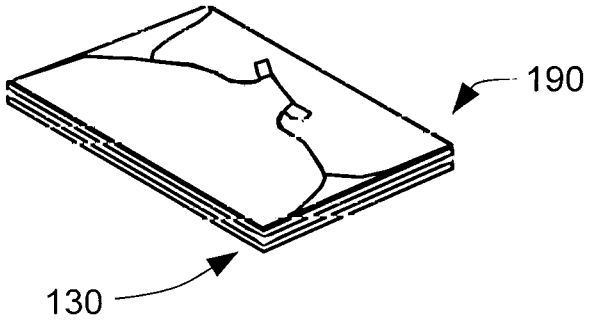
FIG. 16*a* Perspective view of an embodiment of the present invention comprising a collapsible gift box, a collapsible gift cover comprising at least a single mounted extendable flap, false cover, a decoration, a hidden message or a mounting point, showing a storage view of the gift box and cover, showing the front and left sides and top thereof.
Figure 16B:
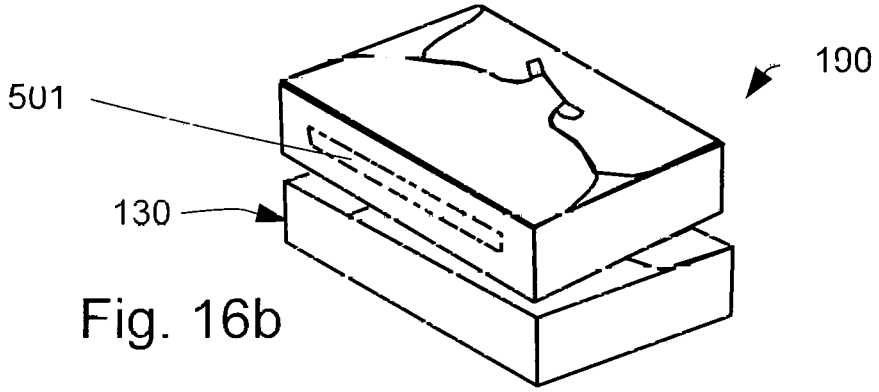
FIG. 16*b* Perspective view of an embodiment of the present invention comprising a collapsible gift box, a collapsible gift cover comprising at least a single mounted extendable flap, false cover, a decoration, a hidden message or a mounting point, showing a deployed view of the gift box and cover, showing the front and left sides and top thereof.
Figure 16C:
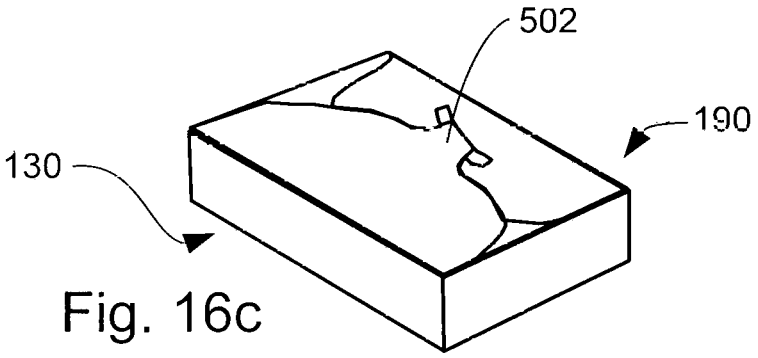
FIG. 16*c* Perspective view of an embodiment of the present invention comprising a collapsible gift box, a collapsible gift cover comprising at least a single mounted extendable flap, false cover, a decoration, a hidden message or a mounting point, showing a ready to ship view of the gift box and cover, showing the front and left sides and top thereof.
Figure 16D:
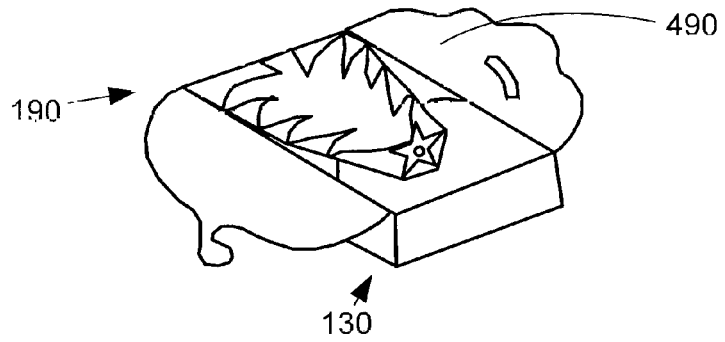
FIG. 16*d* Perspective view of an embodiment of the present invention comprising a collapsible gift box, a collapsible gift cover comprising at least a single mounted extendable flap, false cover, a decoration, a hidden message or a mounting point, showing a received view of the gift box and initial deployment of cover, showing the front and left sides and top thereof.
Figure 16E:
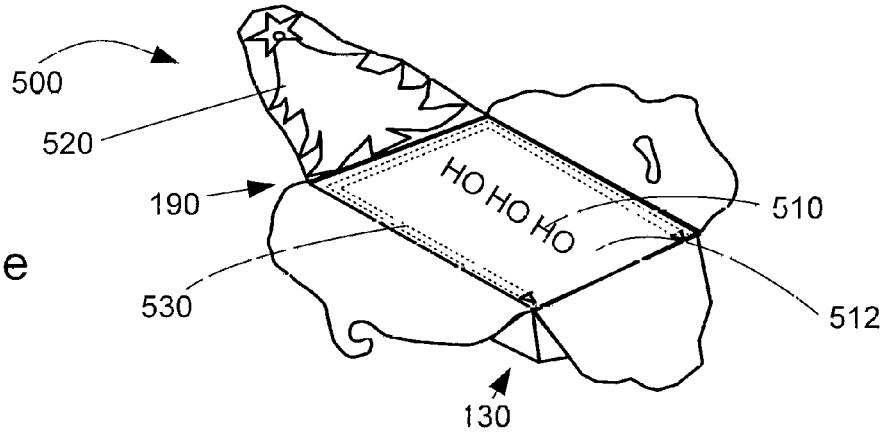
FIG. 16*e* Perspective view of an embodiment of the present invention comprising a collapsible gift box, a collapsible gift cover comprising at least a single mounted extendable flap, false cover, a decoration, a hidden message or a mounting point, showing a deployed view of the gift box and subsequent deployment of cover exposing false cover, decoration and hidden message, showing the front and left sides and top thereof.
Figure 16F:
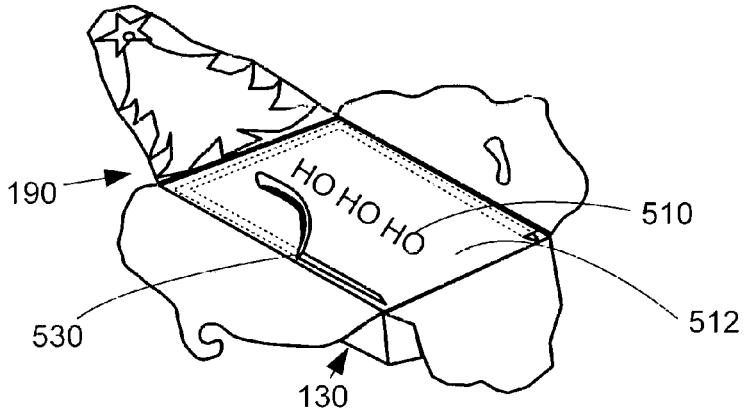
FIG. 16*f* Perspective view of an embodiment of the present invention comprising a collapsible gift box, a collapsible gift cover comprising at least a single mounted extendable flap, false cover, a decoration, a hidden message or a mounting point, showing a ready to open view of the gift box and false cover by removing tear strip, showing the front and left sides and top thereof.
Figure 16G:
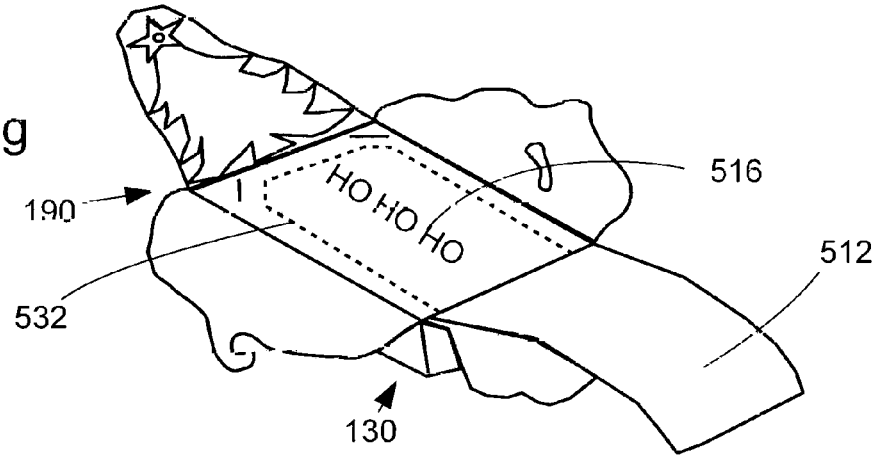
FIG. 16*g* Perspective view of an embodiment of the present invention comprising a collapsible gift box, a collapsible gift cover comprising at least a single mounted extendable flap, false cover, a decoration, a hidden message or a mounting point, showing a ready to open view of the gift box and real cover with false cover flap pulled back, showing the front and left sides and top thereof.
Figure 16H:
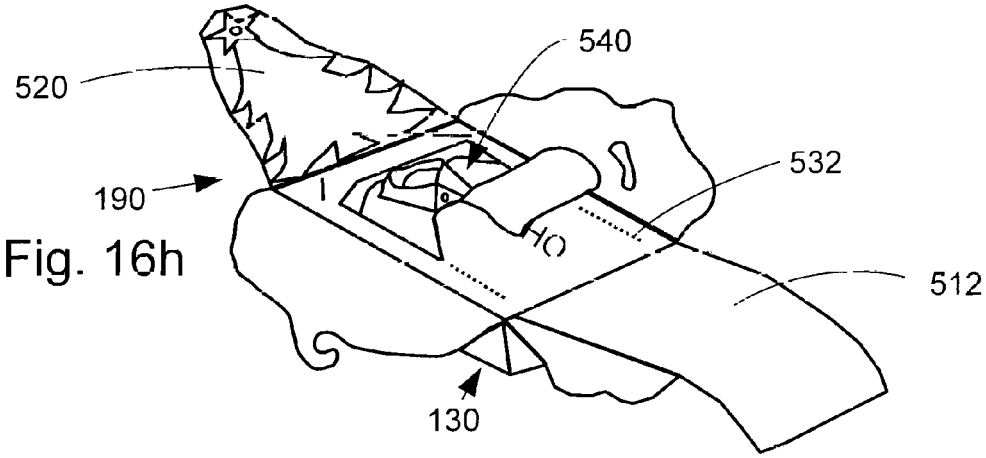
FIG. 16*h* Perspective view of an embodiment of the present invention comprising a collapsible gift box, a collapsible gift cover comprising at least a single mounted extendable flap, false cover, a decoration, a hidden message or a mounting point, showing a opened view of the gift box and gift cover by removing hidden message layer and subsequent gift cover layer exposing gift held in the cavity, showing the front and left sides and top thereof FIG. 16*i* Perspective view of an embodiment of the present invention comprising a collapsible gift box, a collapsible gift cover comprising at least a single mounted extendable flap, false cover, a decoration, a hidden message or a mounting point, showing a secondary use of the gift box and gift cover by filling the empty gift cavity with candy, showing the front and left sides and top thereof.
Figure 16I:
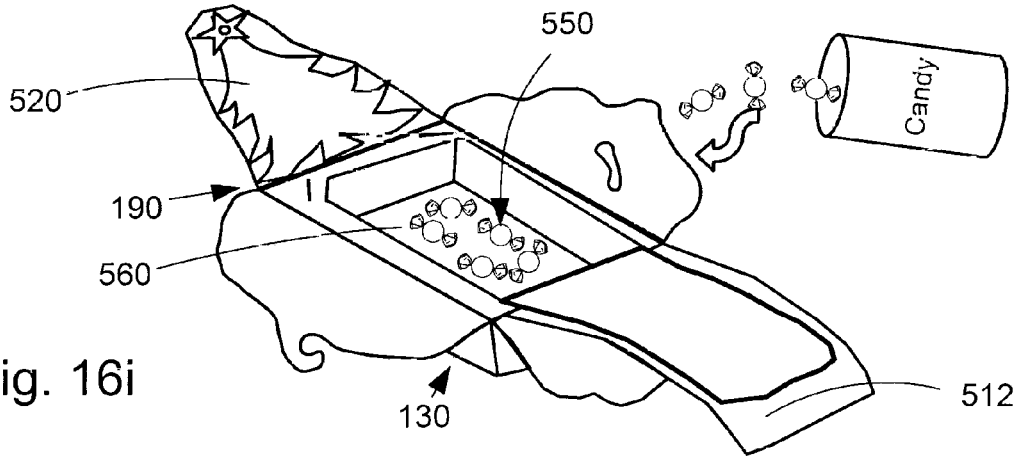
FIG. 16*j* Perspective view of an embodiment of the present invention comprising a collapsible gift box, a collapsible gift cover comprising at least a single mounted extendable flap, false cover, a decoration, a hidden message or a mounting point, showing a secondary use of the gift box and gift cover by re-closing the now filled gift cavity by re-closing real cover, showing the front and left sides and top thereof.
FIG. 16*k* Perspective view of an embodiment of the present invention comprising a collapsible gift box, a collapsible gift cover comprising at least a single mounted extendable flap, false cover, a decoration, a hidden message or a mounting point, showing a secondary use of the gift box and gift cover by re-closing the now filled gift cavity by reattaching false cover, inserting open layer corner tabs in slots, showing the front and left sides and top thereof.
FIG. 16*l* Perspective view of an embodiment of the present invention comprising a collapsible gift box, a collapsible gift cover comprising at least a single mounted extendable flap, false cover, a decoration, a hidden message or a mounting point, showing a secondary use of the gift box and gift cover by finally re-closing the shipping tabs 502 leaving a mounting point available to hang the present invention for use a piñata, showing the front and left sides and top thereof.
Figure 16J:
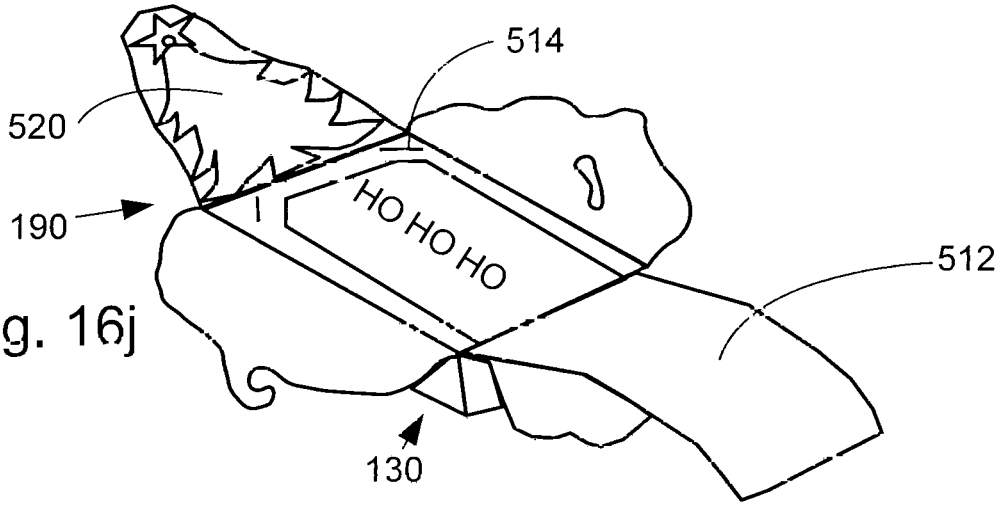
Figure 16K:
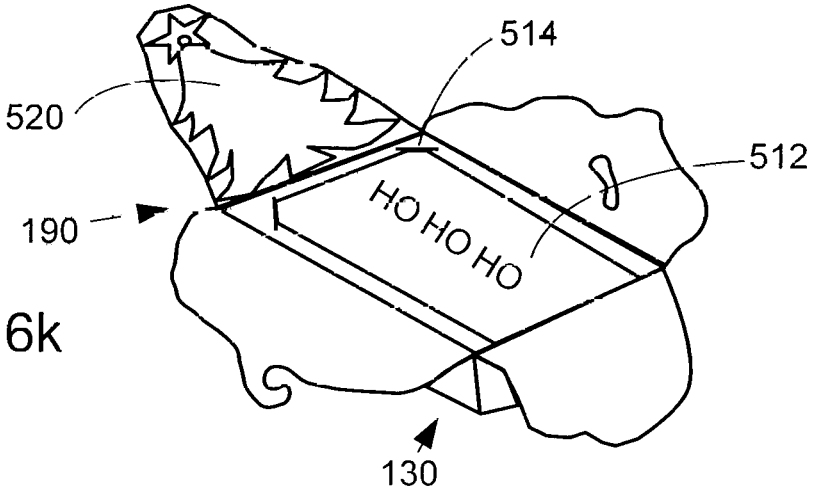
Figure 16L:
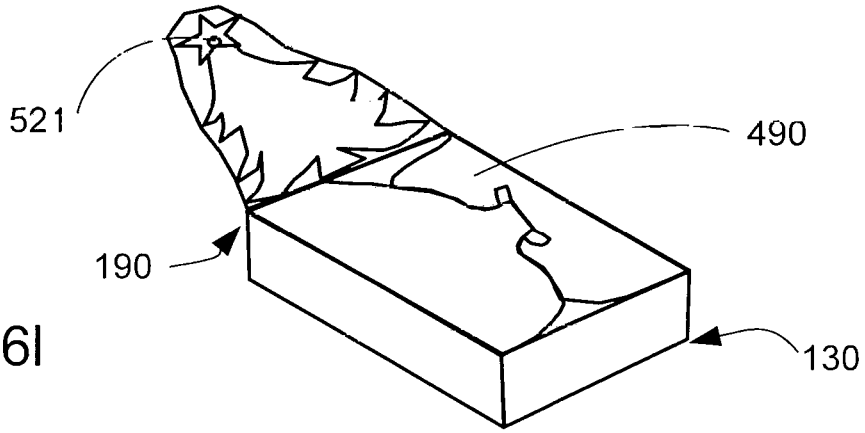

Party Display: In FIGS. 16*a*, 16*b*, and 16*c*, the cover 190 and gift container 130 is presented in is folded storage state, (16*a*), its ready to package a gift state (16*b*) its ready to ship state (16*c*) with shipping tabs 502 engaged. In these three states, the closed cover 190 may also be used to store other items, greeting cards, secondary gifts that would be exposed once the cover 190 is opened in FIG. 16*d*. Then once the gift is received, the cover 190 transforms in FIG. 16*d*, and FIG. 16*e* as it deploys its party display configuration in the form of at least an extendable flap 490. In this example shown in FIG. 16*e*, the gift container 130 and the cover 190 are opened to become a three dimensional party decoration display 500 for the house or the event in which the gift is presented. The gift is still present in the package at this state. At this time, a greeting message 510 is revealed showing a decorated Christmas tree 520 as well. In this embodiment shown in FIG. 16*f*, the present invention teaches another method of prolonging the gift giving experience by adding at least a false cover 512 above the cover 190 in which someone attempting to open the gift is presented with a second message 516 and/or the cover 190. The enjoyment of this mechanism may be compounded by the use of at least a second false cover 512 layered above with the original cover 190 and the first false cover 512. These layered false covers 512 will be displayed sequentially as the gift recipient open the second false cover 512 and then is presented with a first false cover 512, will open that to discover yet another barrier, the cover 190, to prolong the moment of giving. To open the gift, in FIG. 16*e*, a tear strip 530 is provided for the removal of the false cover 512 in FIG. 16*f*. The false cover 512 is viewed and bypassed in FIG. 16*g* by tear strip 532 in cover 190 11A and the gift 540 is revealed and may be removed in FIG. 16*h*. Once the gift is removed, the gift presentation system 370 may now be reused in a number of ways comprising reuse as a gift package as well. One reuse configuration contemplated is a piñata as shown in FIG. 16*l*.

Party Piñata Configuration: If desired, the gift presentation system may be filled with candy 550 may also be re-used or be reconfigured to become a festive party game such as a piñata. Once candy 550 is placed in the cavity 560 of gift container 130, sealed up as shown by exemplars in FIGS. 16*i*, 16*j*, 16*k* and 16*l*, and gift container 130 and cover 190 may then be erected and hung by the top of its decorated Christmas tree's mounting area 521, it may then serve as a piñata. The sealing of the cover 190 in FIG. 16*j* is accomplished by an interference fit between the two edges of the cover 190. The sealing of the false cover 512 in FIG. 16*k* is accomplished by tucking corners of the false cover 512 into pre-cut slots 514. Re-closing the extendable flaps 490 and securing them while leaving the decorated Christmas tree 520 exposed and a mounting area 521 for hanging the piñata available. This completes the reassembly of the cover 190 and gift container 130 into a piñata. This embodiment would require that the gift container 130 and cover 190 comprise a more fragile or frangible type of material to adequately fracture and spill the candy or toys. Exemplars of this material would comprise lighter weight paper or pulp materials that would break when hit with sufficient force, or would comprise pre-scored lines in the gift container 130 to fracture and disgorge the candy 550 or toys.

Although not represented by a figure, it should be apparent to those skilled in the art of gift decoration, that the gift presentation system could also be reused as a storage box, reused as a gift package 326, and among other secondary uses contemplated by the present invention.

Travel game for creative play: This embodiment extends the diorama constructs described above. In this case, the base material for the gift system comprises a thicker cardstock and thin card board for durability and longevity of play. An example of a game intended in this case, might use the three dimensional constructs as described earlier in this specification as game pieces, the gift container 130 might re-articulate into a game board, and at a least a functional element might be used to re-articulate as a spinner or some other type of random chance generator for the users to generate moves or actions. This example is not intended to limit types of games that could be produced in this example.

Lamps or Luminary Displays: Due to the ready availability of LED systems and their low power requirements, the gift system may comprise LED lights or similar lighting schemes as functional elements that either attach to the cover 190 or gift container 130 or are integrated into these components as part of the original configuration. For example, the gift presentation system described in FIG. 16 could have LED lights mounted as lights in the Christmas tree, once the gift is opened, a battery and switch could activate the LED lights to enhance the gift giving process. Additionally, if the cover 190 is configured to comprise a mounting point, the gift system may be hung as a light display for the period that the battery is able to light the LED lights.

Party or other secondary adornments: In this case the cover 190 separates to forms gift article(s) to wear, decorate or affix in some other place. Examples of this comprise 1) Birthday Crowns or Party Hats:

In this example, the gift container 130 and or the cover 190 re-articulate into a hat or crown for the gift recipient. This may be a simple punch-out or it may require the reassembly of various components outlined in the gift container 130 or the cover 190 as described in the toy car example.

2) Photo Mountings or Display:

2) Photo mountings or display: In this case, as shown in FIGS. 11*a* and 11*b*, the cover 190 or a portion of the gift container 130 separates and comprises a recess 575 in which to place a photo 570. Additional adhesive functional elements may be affixed to the back of the recess 575 for the photo 570 mounting to self-adhere to a photo album. This embodiment may also comprise other two and three dimensional functional elements that can be mounted in such a way that when the photo album or scrapbook page is opened a decoration 590 like a multidimensional embellishment to enhance the photo page.

3) Banners or Poster Type Displays:

In this embodiment, the gift container 130 and or the cover 190 and or the functional elements can be deconstructed and joined to form a banner party decoration or room decoration that may fasten to wall or door by conventional means such as mounting tape. An exemplar of this embodiment would have at least a single long strand of tissue paper folded onto itself many times such that when tightly bundled into an appropriate length, becomes a stiffener for the cover 190 as described in a number of other embodiments of this present invention. Once the gift is delivered and ready for presentation, the bundling is removed and the tissue paper deployed in a long streamer to enhance the presentation. A number of streamers could also be created and bundled in this same manner to allow a number of streamer configurations in accordance with this present invention. The streamers could then be attached to ceiling or walls of a room to enhance the gift presentation.

4) Puzzles:

In this embodiment, the gift container 130 and the cover 190 deconstruct into puzzle pieces that when detached from the gift container 130 and cover 190, will reassemble into a desired picture, or in the case of gift container material that the puzzle pieces are created from being structurally stiff enough to create a three dimensional construction puzzles similar to those commonly sold in puzzle stores

Exemplars of Improvements to the Functional Element in a Gift System

The functional elements can comprise a number of types:

1) Bag Space Maximizers: A bag space maximizer is simply a functional element attached to a gift bag 10 or cover 190 to keep the cover 190 from collapsing and allowing a gift to fill up most of the gift bag 10. This functional element may be accomplished by adding a structure to the gift bag that when it is unfolded, creates a locking mechanism to hold the gift bag 10 open (i.e. Locking hinge) or creates a locking structure in the cover 190 to hold the opening 60 of the gift bag 10 to full or nearly full expansion. The cover 190 can do this with a structural crease 194 providing this function as described earlier or by having a similar locking mechanism as the gift bag 10 described in this embodiment (locking hinge) that once unfolded, becomes a structural member that holds open the gift bag 10.

2) Hanging Tab Stiffener is a stiffening member 184 that allows the cover 190 to be folded prior to deployment is the application of a piece of resilient, elastic material over the storage crease 186 in the cover 190 which has been prefolded (i.e. a thin layer of plastic). This elastic material also comprises a tab or hanger that would allow this cover 190 to be hung on a point of sale display. Once deployed as a cover 190, this resilient, elastic material would develop a spring constant to allow the cover 190 to be deployed in a structural arch as earlier described in FIG. 9

3) Greeting Card or Secondary Gift Mount A decorative element, the gift tag 200 that serves as a greeting card/message, the mounting slot 195 may be attached to the cover 190 or the gift container 130 and maybe mounted to be visible by the gift recipient or it may be attached to be hidden within the gift container 130 or to the bottom surface 164 of the cover 190. This gift tag 200 further comprises a mounting clip adhesively attached to the gift container 130 or cover 190, a decoration 210, or any other means of mounting other secondary functional elements. Examples of this mount are shown in FIG. 3*b* with mounting slot 195.

Exemplar of Improved Methods of Merchandising the Present Invention

Improved Methods of Merchandising:

The flexibility and diversity of the types of options contemplated by this invention, allows a new style of merchandising to be accomplished thereby creating a method of selling a uniquely customizable gift presentation system contemporaneous with the sale of a gift such that the gift presentation can be customized and delivered with the gift by a retailer. Whereas this invention may be vended separately at a point of sale retailer, the new manner of packaging contemplated by this invention comprises the following steps: Step 001 is that when a gift giver orders a gift from an online retailer (i.e. Amazon®), Step 002 of this process would allow the gift giver to also specify how the gift should be decorated using this gift presentation system, with the user specifying secondary gifts (Parallel Step 003), (i.e. gift cards), select greeting cards or other fun messages (Parallel Step 003), select hidden messages (Parallel Step 003), select anti-tampering features (Parallel Step 003), or select other functional elements, like three dimensional pop up displays 220, or other decorative elements (Parallel Step 003) The gift container 130 could either be assembled and shipped with full presentation directly to the gift recipient(s) if using the pre-decorated shipping ready embodiment of the present invention (Parallel Step 004) or all of the elements required to enclose the gift and to present it, would shipped to the desired recipient to assemble themselves when the gift arrives (Parallel Step 004)

With respect to the above description then, it is to be realized that the optimum dimensional relationships for the various parts of the invention, to comprise variations in size, materials, shape, form, function and manner of operation, assembly and use, are deemed readily apparent and obvious to one skilled in the art, and all equivalent relationships to those illustrated in the drawings and described in the specification: all are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A gift presentation system comprising:

a gift bag comprising at least four side edge connected side walls, each side wall connected at its side edge to an adjacent side wall edge, each side wall connected at a bottom edge of each side wall to a bottom panel of the gift bag, with a cavity formed by the interiors surfaces of the side walls and bottom panel, and an opening formed by the connected top edge of each side wall of the gift bag;

a cover operably attached to the opening of the gift bag, the cover placed over at least one contained gift in the cavity of the gift bag and the cover is operably attached to the gift bag using an adhesive that joins at least one of the top edges of the side walls of the gift bag to the cover, wherein the adhesive also conceals a message that is revealed when the cover is moved; and an at least one decorative element operably attached to the cover that also operably assists to secure the cover to the gift bag.

2. A gift presentation system comprising:

a gift bag comprising at least four side edge connected side walls, each side wall connected at its side edge to an adjacent side wall edge, each side wall connected at a bottom edge of each side wall to a bottom panel of the gift bag, with a cavity formed by the interiors surfaces of the side walls and bottom panel, and an opening formed by the connected top edge of each side wall of the gift bag;

a cover operably attached to the opening of the gift bag, the cover placed over at least one contained gift in the cavity of the gift bag and the cover is operably attached to the gift bag; and an at least one decorative element operably attached to the cover that also operably assists to secure the cover to the gift bag, wherein the at least one decorative element operably connected to the cover further comprises at least a single mounting slot wherein an at least a secondary gift item is attached to the cover.

* * * * *